US011848524B2

(12) United States Patent
Maesoba et al.

(10) Patent No.: US 11,848,524 B2
(45) Date of Patent: Dec. 19, 2023

(54) CABLE WITH CONNECTOR INCLUDING CONDUCTOR CONNECTED TO THE CABLE

(71) Applicants: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

(72) Inventors: Hiroyoshi Maesoba, Mie (JP); Toshifumi Ichio, Mie (JP)

(73) Assignees: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

( * ) Notice: Subject to any disclaimer, the term of this patent is extended or adjusted under 35 U.S.C. 154(b) by 257 days.

(21) Appl. No.: 17/418,461

(22) PCT Filed: Dec. 24, 2019

(86) PCT No.: PCT/JP2019/050525
§ 371 (c)(1),
(2) Date: Jun. 25, 2021

(87) PCT Pub. No.: WO2020/138037
PCT Pub. Date: Jul. 2, 2020

(65) Prior Publication Data

US 2022/0149570 A1 May 12, 2022

(30) Foreign Application Priority Data

Dec. 28, 2018 (JP) ..... 2018-247608

(51) Int. Cl.
*H01R 13/6591* (2011.01)
*H01R 4/18* (2006.01)
(Continued)

(52) U.S. Cl.
CPC ..... *H01R 13/65912* (2020.08); *H01R 4/184* (2013.01); *H01R 13/6581* (2013.01);
(Continued)

(58) Field of Classification Search
CPC ..... H01R 13/65912; H01R 4/184; H01R 13/6581; H01R 4/18; H01R 4/183;
(Continued)

(56) References Cited

U.S. PATENT DOCUMENTS 5,199,903 A 4/1993 Asick et al.
5,518,421 A 5/1996 Davis
(Continued)

FOREIGN PATENT DOCUMENTS

JP 2000-012165 A 1/2000

OTHER PUBLICATIONS

International Search Report dated Feb. 18, 2020 for WO 2020/138037 A1 (5 pages).

*Primary Examiner* — Abdullah A Riyami
*Assistant Examiner* — Justin M Kratt
(74) *Attorney, Agent, or Firm* — Venjuris, P.C.

(57) ABSTRACT

A cable with terminal disclosed by this specification is provided with a shielded cable 11 including a conductive shield portion 15 for covering outer peripheries of two coated wires 12 and a sheath portion 16 for covering an outer periphery of the shield portion 15, a first outer conductor 51 made of metal and including a tubular portion 52 in the form of a rectangular tube, and a second outer conductor 60 including plate-like fixing barrels 62 to be crimped to wind around an outer surface of the tubular portion 52 in a
(Continued)

circumferential direction. The tubular portion 52 includes a depressed portion 57 arranged inside to radially face the fixing barrels 62 and allowing the fixing barrels 62 to be crimped by causing the fixing barrels 62 to be excessively deformed beyond proper crimping positions.

5 Claims, 23 Drawing Sheets

(51) Int. Cl.

| | |
|---|---|
| ***H01R 13/6581*** | (2011.01) |
| *H01R 13/6592* | (2011.01) |
| *H01R 9/05* | (2006.01) |
| *H01R 9/03* | (2006.01) |
| *H01R 13/6593* | (2011.01) |

(52) U.S. Cl.
CPC ..... *H01R 4/18* (2013.01); *H01R 4/183* (2013.01); *H01R 4/186* (2013.01); *H01R 9/03* (2013.01); *H01R 9/05* (2013.01); *H01R 9/0518* (2013.01); *H01R 13/6591* (2013.01); *H01R 13/6592* (2013.01); *H01R 13/6593* (2013.01)

(58) Field of Classification Search
CPC . H01R 4/186; H01R 9/03; H01R 9/05; H01R 13/6591; H01R 13/6592; H01R 9/0518; H01R 13/6593
See application file for complete search history.

(56) References Cited

U.S. PATENT DOCUMENTS

| | | | | |
|---|---|---|---|---|
| 8,926,368 | B2 * | 1/2015 | Il | H01R 13/658 439/607.5 |
| 10,910,733 | B2 * | 2/2021 | Miyamoto | H01R 4/185 |
| 2013/0288522 | A1 | 10/2013 | Il | |

* cited by examiner

CABLE WITH CONNECTOR INCLUDING CONDUCTOR CONNECTED TO THE CABLE

CROSS REFERENCE TO RELATED APPLICATIONS

This application is a national phase of PCT application No. PCT/JP2019/050525, filed on 24 Dec. 2019, which claims priority from Japanese patent application No. 2018-247608, filed on 28 Dec. 2018, all of which are incorporated herein by reference.

TECHNICAL FIELD

A technique disclosed by this specification relates to a cable with terminal and a connector.

BACKGROUND

A shield connector connected to an end of a shielded cable for transmitting a communication signal is, for example, known from Japanese Unexamined Patent Publication No. 2013-229255 (Patent Document 1 below). This shield connector includes a male terminal to be connected to a shield wire exposed by stripping a shield foil and a sheath portion of the shielded cable, an inner housing for accommodating the male terminal, a shield shell including a tubular portion for covering the inner housing and to be connected to the shield foil of the shielded cable, and a shield shell cover for covering the shield shell.

The shield shell cover is fixed to the shield shell by locking locking claws provided on side plate portions on both sides of the shield shell into locking holes formed in both side parts of the shield shell cover.

PRIOR ART DOCUMENT

Patent Document

Patent Document 1: JP 2013-229255 A

SUMMARY OF THE INVENTION

Problems to be Solved

By crimping an extending piece formed to extend from a second conductor to wind around the outer peripheral surface of a first conductor as means for fixing the second conductor made of metal and equivalent to the shield shell cover to the first conductor made of metal and equivalent to the shield shell, the second conductor can be fixed to the first conductor without complicating the structures of the conductors, such as by forming the locking claws on the first conductor and forming the locking holes in the second conductor.

However, if the extending piece of the second conductor is crimped to wind around the outer peripheral surface of the first conductor, there is a concern that the extending piece is lifted from the outer surface of the first conductor due to so-called springback of the extending piece deformed by crimping to slightly return to an initial state.

A technique for suppressing the occurrence of springback in a conductor is disclosed in this specification.

Means to Solve the Problem

The technique disclosed by this specification is directed to a cable with terminal including a shielded cable having a conductive shield portion for covering an outer periphery of at least one coated wire and a sheath portion for covering an outer periphery of the shield portion, a first conductor made of metal, having a tubular connecting portion and to be connected to the shield portion, and a second conductor having at least one plate-like barrel to be crimped to wind around an outer surface of the connecting portion in a circumferential direction, the connecting portion having a depressed portion arranged inside to radially face the barrel and allowing the barrel to be crimped by causing the barrel to be excessively deformed beyond a proper crimping position.

Further, the technique disclosed by this specification is directed to a connector including the above cable with terminal and a housing for accommodating the cable with terminal.

According to the cable with terminal thus configured, the barrel of the second conductor can be crimped to the connecting portion by being caused to be excessively deformed to enter the depressed portion when the barrel is crimped to wind around the connecting portion of the first conductor in the circumferential direction.

That is, the excessively deformed barrel by being caused to enter the depressed portion slightly returns to an initial state due to springback and is arranged at the proper crimping position. In this way, it can be suppressed that the barrel is arranged at an improper crimping position lifted from the connecting portion.

The cable with terminal disclosed by this specification may be configured as follows.

The depressed portion may be a bottomed recess recessed from the outer surface of the connecting portion, and the depressed portion may not penetrate through the connecting portion.

According to this configuration, by excessively deforming the barrel in the depressed portion of the connecting portion, the arrangement of the barrel at an improper crimping position can be suppressed and the formation of a through hole in the connecting portion can be prevented, whereby a reduction in the shielding performance of the connecting portion can be suppressed.

The depressed portion may be formed at a position radially facing a tip part of the barrel.

Generally, if a plate-like metal piece is crimped to wind around something, a tip part of the metal piece tends to be largely lifted due to springback. However, according to this configuration, since the depressed portion is formed at the position radially facing the tip part of the barrel, it can be suppressed that the tip part of the barrel largely affected by lifting due to springback is arranged at an improper crimping position.

The second conductor may include a plurality of the barrels, and the depressed portion may be formed in such a size that tip parts of the plurality of barrels collectively enter the depressed portion.

According to this configuration, the tip parts of the plurality of barrels can collectively enter one depressed portion in crimping the plurality of barrels. Thus, it can be suppressed that the shape of the tubular portion, eventually of the first conductor, becomes complicated as compared to the case of forming a plurality of depressed portions into which the tips of the plurality of barrels can individually enter.

The shielded cable may include a plurality of the coated wires, the cable with terminal may further include a terminal accommodating member to be accommodated into the connecting portion with terminals connected to the coated wires accommodated side by side in the terminal accommodating member, and the terminal accommodating member may be provided with a recessed portion formed by being recessed along the depressed portion and having a bottom part in a region different from regions, where the terminals are arranged, in an arrangement direction of the terminals.

According to this configuration, the thinning of a wall part constituting a part for accommodating the terminals can be suppressed by forming the recessed portion in the terminal accommodating member.

Effect of the Invention

According to the technique disclosed by this specification, it is possible to suppress the occurrence of springback in a conductor.

DETAILED DESCRIPTION TO EXECUTE THE INVENTION

First Embodiment

A first embodiment of the technique disclosed in this specification is described with reference to FIGS. 1 to 22.

A connector 10 for communication to be installed, for example, in a vehicle such an electric vehicle or hybrid vehicle and disposed in a wired communication path, for example, between an in-vehicle electrical component (car navigation system, ETC, monitor or the like) in the vehicle and an external device (camera or the like) or between in-vehicle electrical components is illustrated in this embodiment.

The connector 10 is connectable to an unillustrated mating connector and includes, as shown in FIGS. 1 to 4, a housing 70 and a terminal module (example of a "cable with terminal") 68 to be accommodated into the housing 70. Note that, in FIGS. 1 to 4, the terminal module 68 is accommodated in a vertically inverted state in the housing 70.

Figure 1:
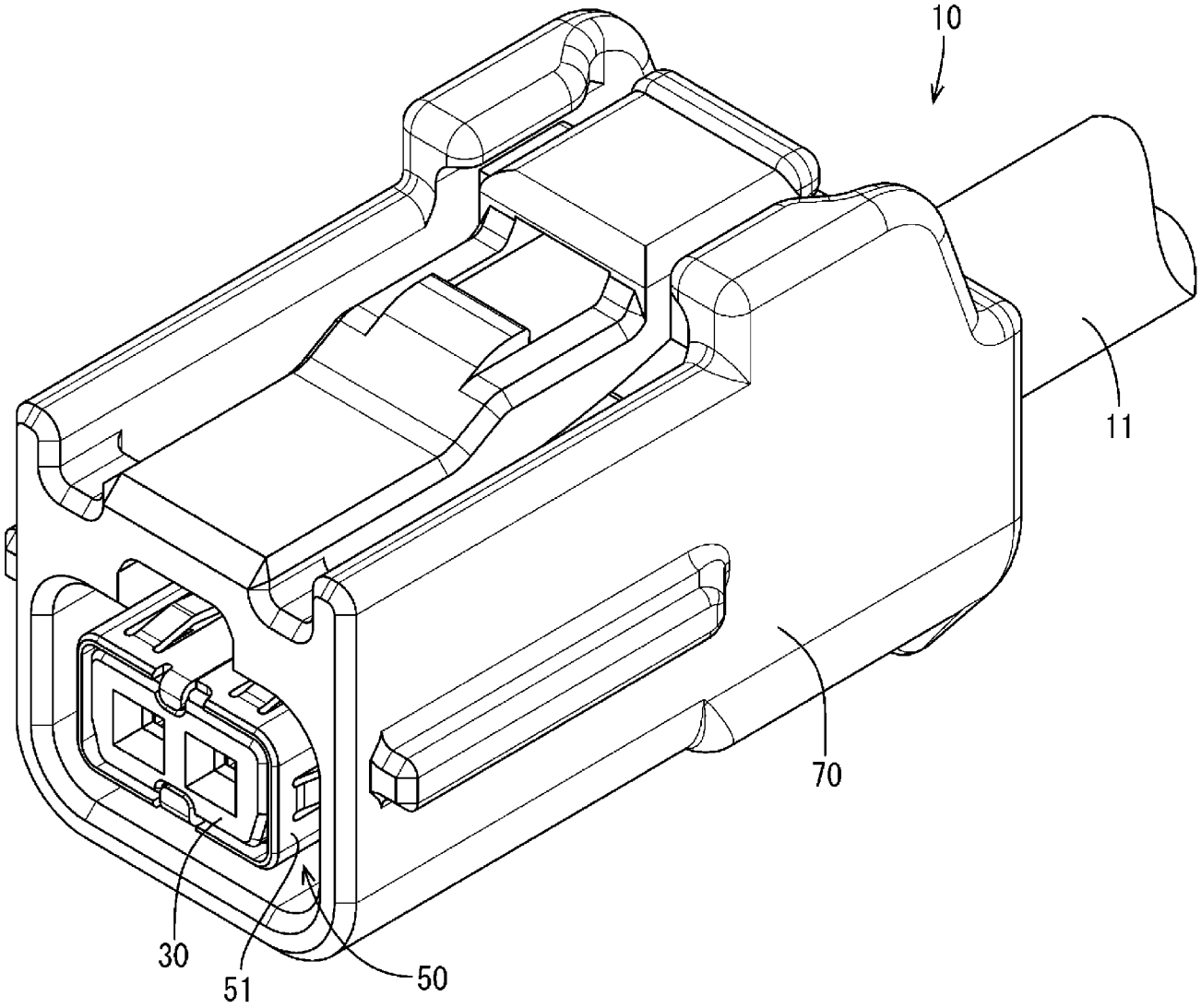
FIG. 1 is a perspective view of a connector according to a first embodiment.
Figure 2:
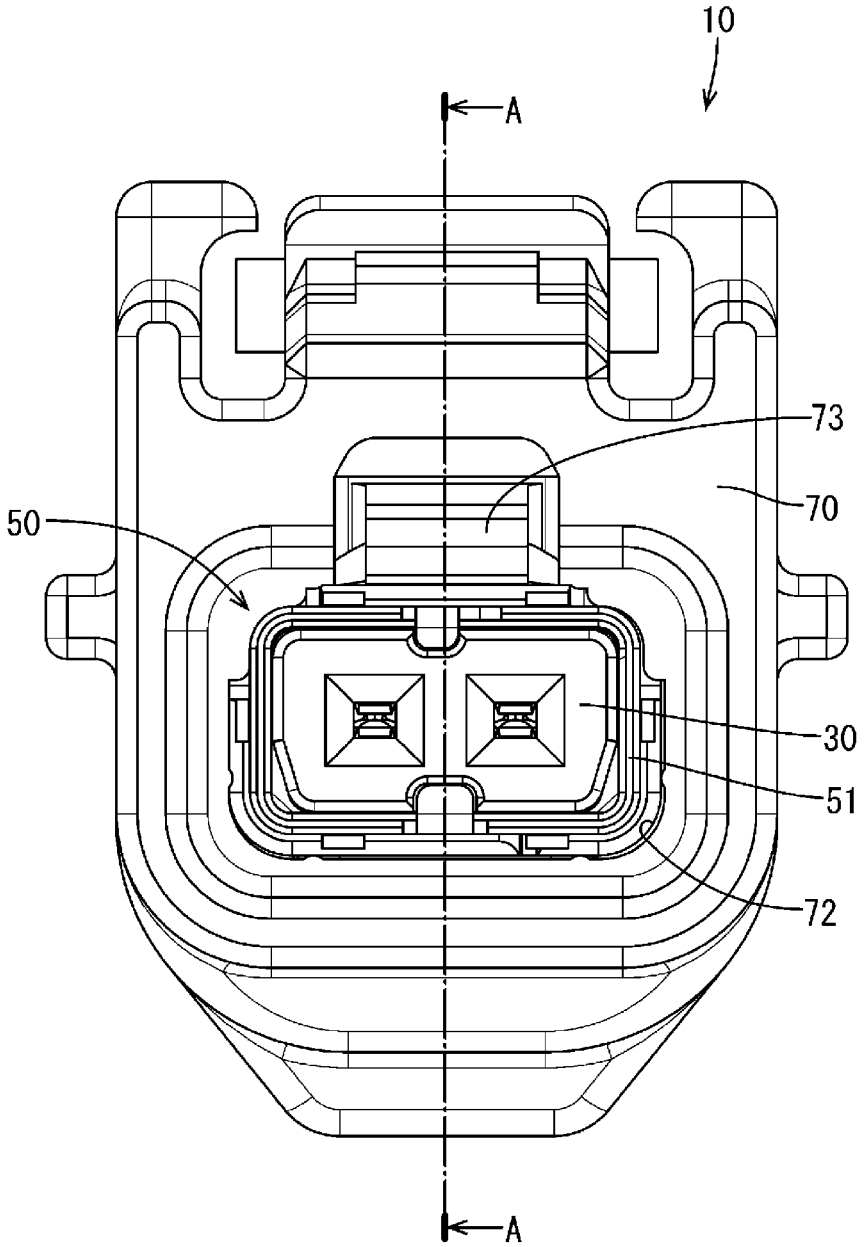
FIG. 2 is a front view of the connector.
Figure 3:
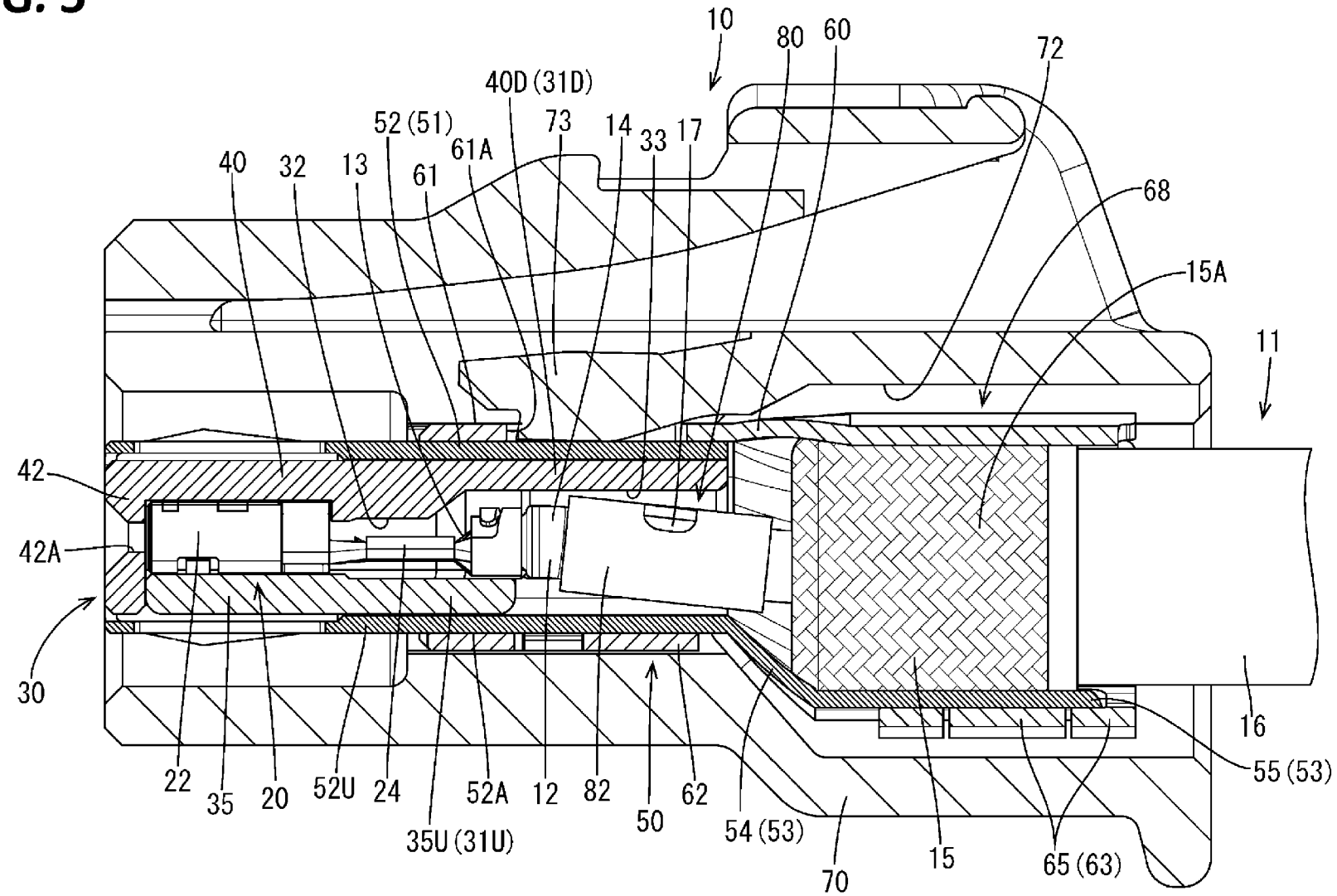
FIG. 3 is a section along A-A of FIG. 2.

The housing 70 is made of synthetic resin and includes, as shown in FIG. 3, a module accommodating portion 72 for accommodating the terminal module 68.

As shown in FIGS. 1 to 4, the module accommodating portion 72 is substantially in the form of a rectangular tube penetrating in the front-back direction, and a locking lance 73 lockable to an edge part of a lance hole 61A provided in a later-described outer conductor 50 of the terminal module 68 is provided in the module accommodating portion 72. The locking lance 73 is fit into the lance hole 61A as shown in FIG. 3 if the terminal module 68 is accommodated at a proper accommodation position of the module accommodating portion 72, and the terminal module 68 is held in the housing 70 by the locking of the locking lance 73 and the edge part of the lance hole 61A.

The terminal module 68 includes a shielded cable 11, a plurality of inner conductors 20 to be connected to a front end of the shielded cable 11, a terminal accommodating member 30 for accommodating the plurality of inner conductors 20, an outer conductor 50 to be connected to the shielded cable 11 while covering the outer periphery of the terminal accommodating member 30, and the housing 70 for accommodating the outer conductor 50.

The shielded cable 11 includes a plurality of coated wires 12, a shield portion 15 constituted by a braided wire for collectively covering the outer peripheries of the plurality of coated wires 12, and a sheath portion 16 constituted by an insulating coating for covering the outer periphery of the shield portion 15. In the shielded cable 11 of this embodiment, two coated wires 12 are collectively covered by the shield portion 15.

Each coated wire 12 is formed such that a conductive core 13 is covered by an insulating insulation coating 14. The two coated wires 12 are twisted in a state covered by the shield portion 15, and the sheath portion 16 is stripped in a front end part of the shielded cable 11 to expose the untwisted two coated wires 12 and the shield portion 15.

The shield portion 15 is formed by braiding a plurality of conductive metal thin wires into a tube. The shield portion 15 exposed from an end of the sheath portion 16 is folded on an end part of the sheath portion 16 to cover the outer periphery of the end part of the sheath portion 16, and this folded part of the shield portion 15 serves as a folded portion 15A.

In a front end part of each coated wire 12 pulled out forward from the folded portion 15A, the insulation coating 14 is stripped to expose the core 13, and the inner conductor 20 is electrically connected to the exposed core 13.

The inner conductor 20 includes a connecting tube portion 22 in the form of a rectangular tube into which a pin-like mating connecting portion of an unillustrated mating inner conductor provided in the mating connector is inserted to be connected, and a wire connecting portion 24 connected behind the connecting tube portion 22 and to be crimped and connected to the core 13 and an end of the insulation coating 14.

A part of the coated wire 12 exposed from the shield portion 15 between the inner conductor 20 and the folded portion 15A of the shield portion 15 serves as an exposed portion 17, and an adjusting member 80 for adjusting an impedance in the exposed portion 17 is mounted on the exposed portion 17.

The adjusting member 80 is formed by working a conductive metal plate material by a press or the like. The adjusting member 80 includes two adjusting bodies 82 to be respectively mounted on the outer peripheries of the exposed portions 17 in the coated wires 12 and a coupling portion 85 coupling the two adjusting bodies 82.

Each adjusting body 82 is formed into a substantially hollow cylindrical shape to cover the outer peripheral surface of the exposed portion 17 in a circumferential direction. The adjusting body 82 is mounted in a substantially central part in a front-back direction of the exposed portion 17, and a length in the front-back direction of the adjusting body 82 is somewhat shorter than that of the exposed portion 17.

Figure 12:
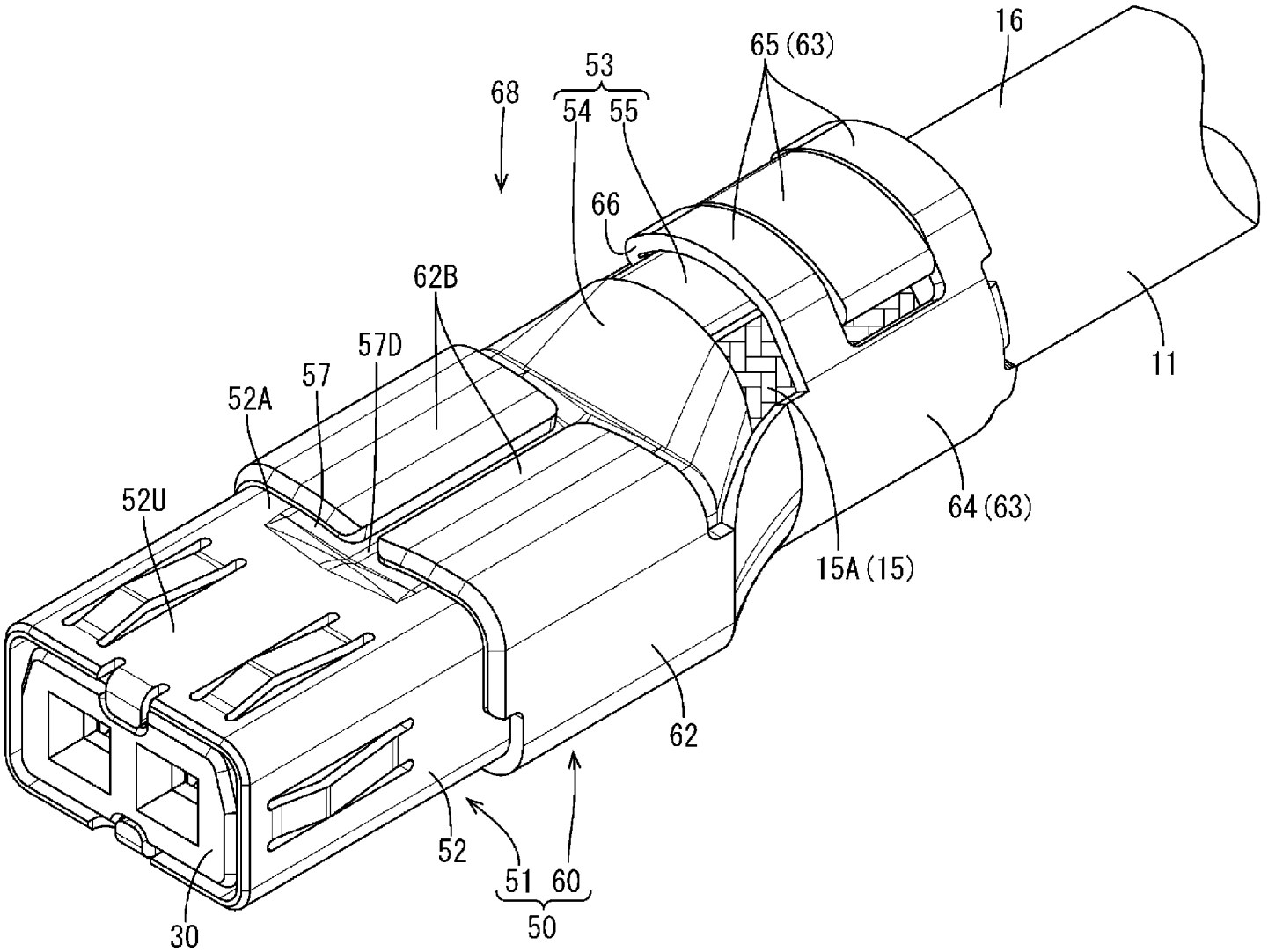
FIG. 12 is a perspective view of a terminal module in which fixing barrels are excessively deformed.

The coupling portion 85 is curved to bulge upward and couples the two adjusting bodies 82 in a lateral direction. Further, as shown in FIG. 12, the coupling portion 85 is formed to be laterally wider in a front part than in a back part. Thus, the adjusting member 80 is laterally wider in a front part than in a back part.

Figure 6:
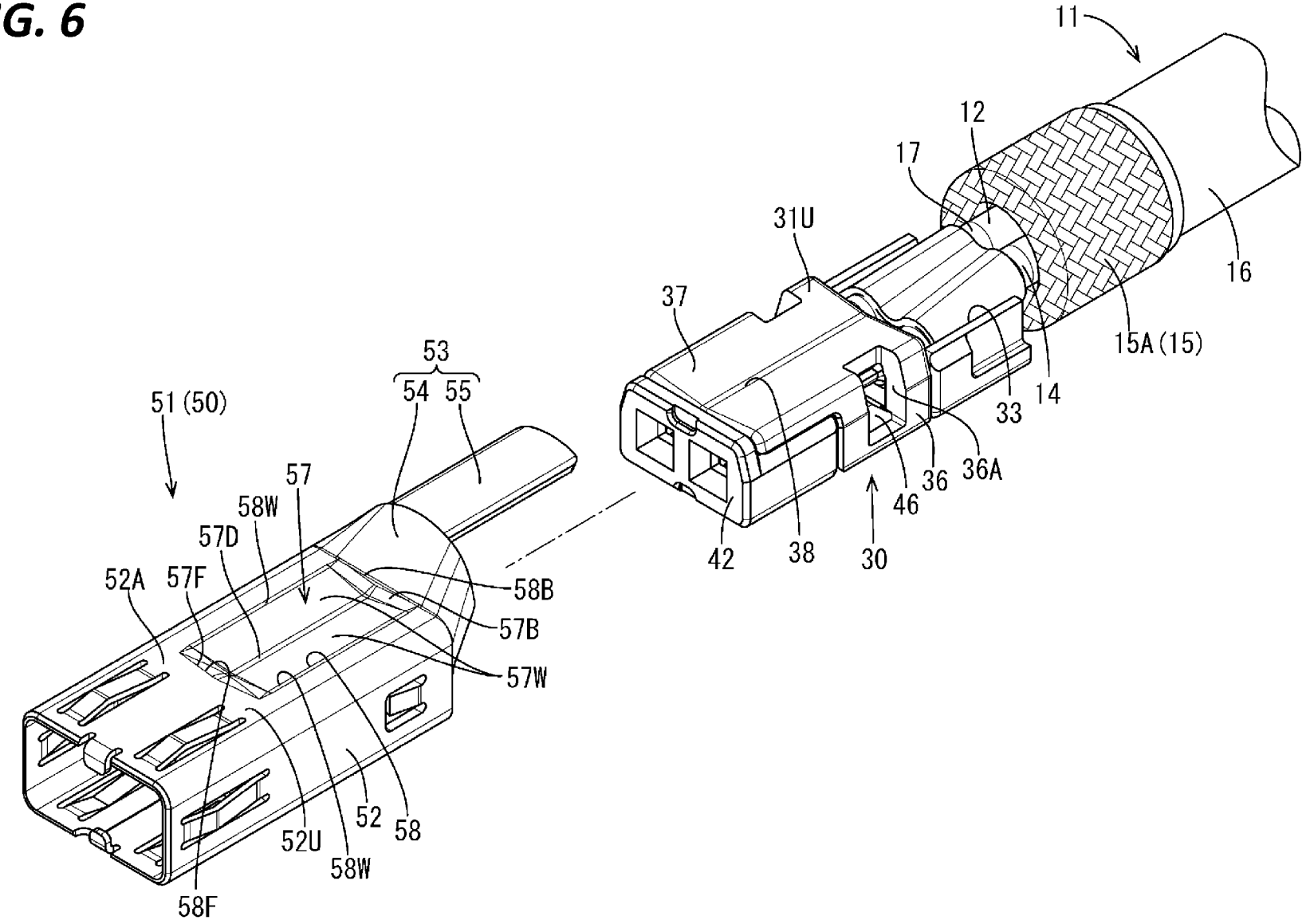
FIG. 6 is a perspective view showing a state before a terminal accommodating member is assembled with a first outer conductor.

The terminal accommodating member 30 is made of synthetic resin and, as shown in FIG. 6, in the form of a rectangular parallelepiped long in the front-back direction.

Figure 9:
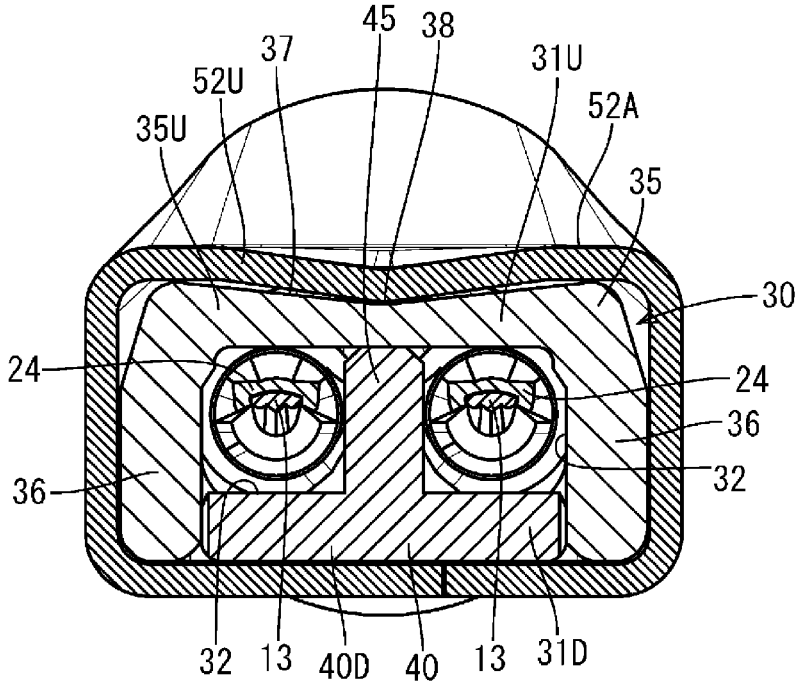
FIG. 9 is a section along B-B of FIG. 8.

As shown in FIG. 9, cavities 32 extending in the front-back direction are formed side by side in the lateral direction on a side of the terminal accommodating member 30 forward of a central part in the front-back direction. The inner conductors 20 connected to the coated wires 12 are accommodated in the respective cavities 32.

A back part of the terminal accommodating member 30 serves as a large accommodating portion 33 for accommodating the exposed portions 17 pulled out backward from the two inner conductors 20 with the adjusting member 80 mounted.

Figure 4:
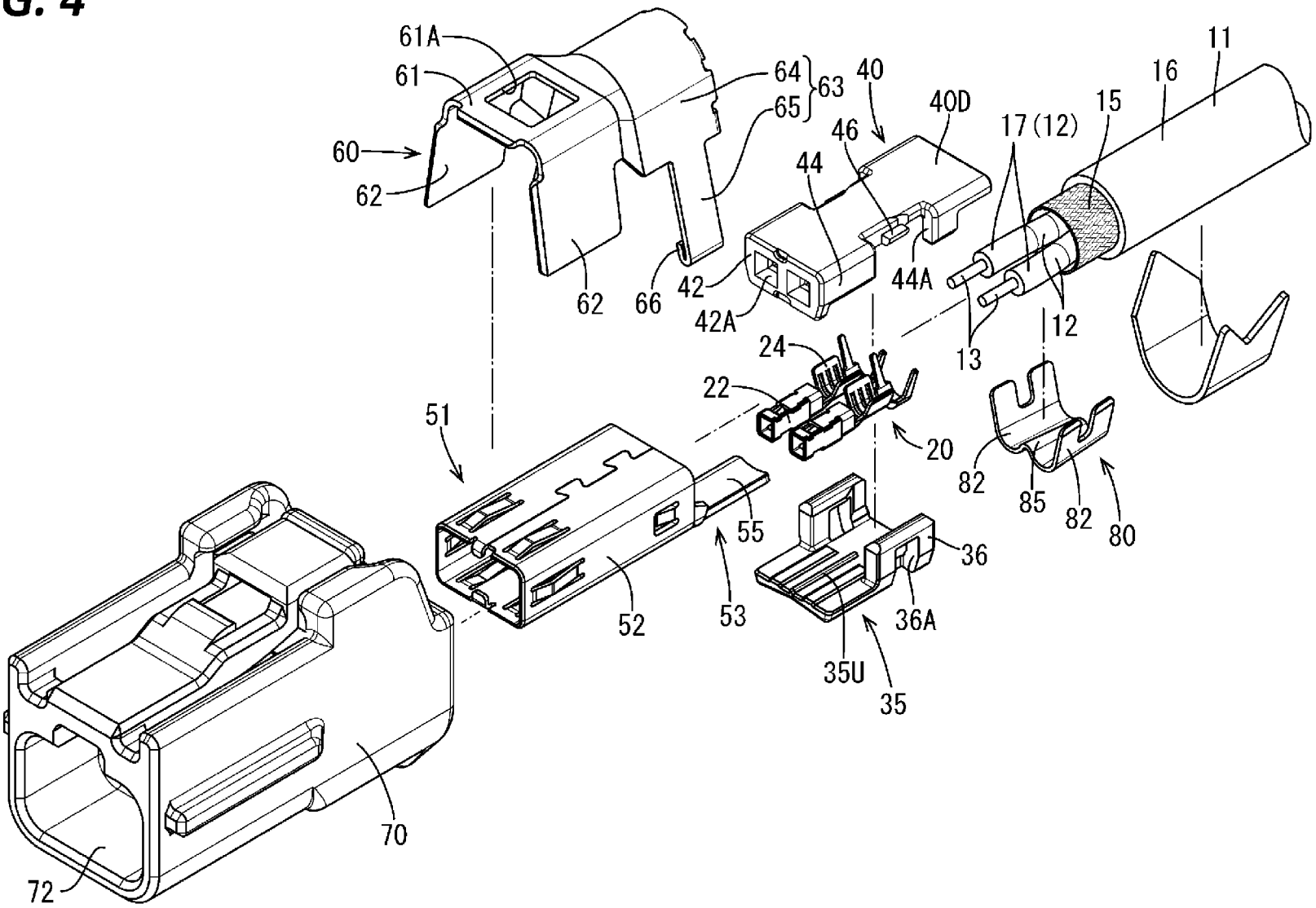
FIG. 4 is an exploded perspective view of the connector.
Figure 5:
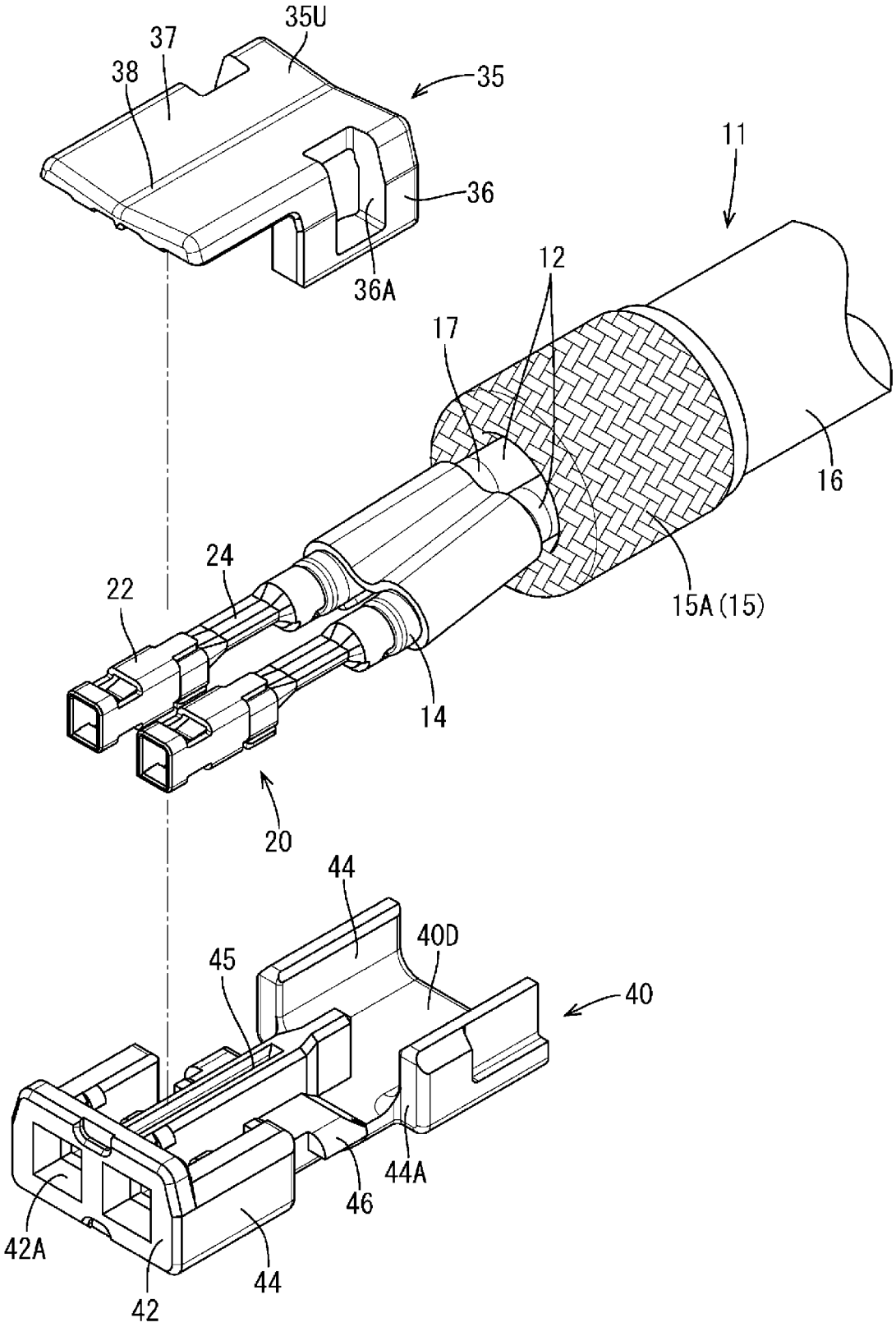
FIG. 5 is a perspective view showing a state before a lower member, inner conductors and an upper member are assembled.

Further, as shown in FIGS. 4 to 6, the terminal accommodating member 30 is configured by assembling an upper member 35 to be arranged in an upper part and a lower member 40 to be arranged in a lower part in a vertical direction.

Figure 18:
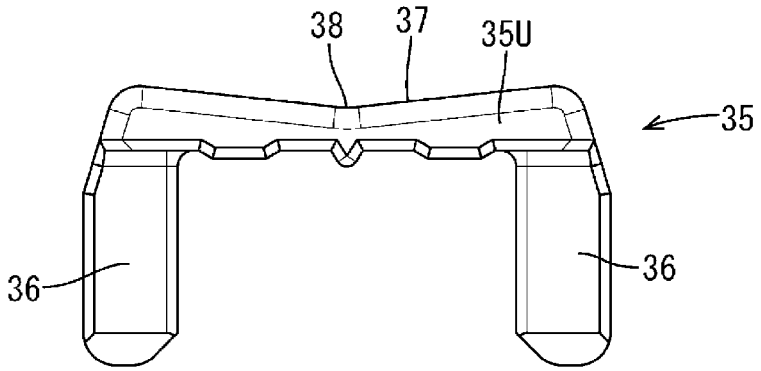
FIG. 18 is a front view of the upper member.

As shown in FIGS. 4, 5 and 18, the upper member 35 includes a ceiling wall 35U constituting an upper wall 31U of the terminal accommodating member 30 and a pair of locking pieces 36 provided on both side edges of the ceiling wall 35U. The ceiling wall 35U is in the form of a substantially rectangular plate long in the front-back direction, and assembled with the lower member 40 to cover the two inner conductors 20 from above.

The pair of locking pieces 36 are formed to extend downward in a substantially central part in the front-back direction of the ceiling wall 35U, and each locking piece 36 includes a substantially rectangular locking hole 36A penetrating in the lateral direction.

As shown in FIGS. 4 and 5, the lower member 40 includes a bottom wall 40D constituting a lower wall 31D of the terminal accommodating member 30, a front wall 42 provided on a front end part of the bottom wall 40D and side walls 44 respectively provided on both lateral side edges of the bottom wall 40D.

The bottom wall 40D is in the form of a substantially rectangular flat plate long in the front-back direction, and the two inner conductors 20 can be placed thereon. A separation wall 45 extending upward from the bottom wall 40D is formed in a substantially laterally central part of the bottom wall 40D. When the lower member 40 and the upper member 35 are assembled, the separation wall 45 is proximately disposed to vertically face the ceiling wall 35U of the upper member 35 and the two cavities 32 for accommodating the inner conductors 20 are configured in the terminal accommodating member 30 as shown in FIG. 9.

As shown in FIG. 6, the front wall 42 is in the form of a plate extending upward from the front end edge of the bottom wall 40D and provided with insertion openings 42A into which male terminals are to be inserted.

A pair of the side walls 44 respectively extend upward from the bottom wall 40D and are formed to be continuous with side edges on both lateral sides of the front wall 42.

A fitting recess 44A into which the locking piece 36 of the upper member 35 is fit when the lower member 40 and the upper member 35 are assembled is formed in a substantially central part in the front-back direction of each side wall 44. The fitting recess 44A is recessed inwardly from the side surface of the side wall 44, and a locking projection 46 projecting laterally outward is formed on the bottom wall 44D located inside the fitting recess 44A.

The locking projections 46 are fit into the locking holes 36A of the locking pieces 36 to hold the lower member 40 and the upper member 35 in an assembled state as shown in FIG. 6 when the lower member 40 and the upper member 35 are assembled and the locking pieces 36 of the upper member 35 are fit into the fitting recesses 44A.

The outer conductor 50 is fittable and connectable to an unillustrated mating outer conductor provided in the mating connector and, as shown in FIGS. 11 to 17, is composed of a first outer conductor (example of a "first conductor") 51 for covering the outer periphery of the terminal accommodating member 30 and a second outer conductor (example of a "second conductor") 60 to be assembled with the first outer conductor 51 to cover the outer peripheries of the first outer conductor 51 and the folded portion 15A of the shielded cable 11.

The first outer conductor 51 is formed by working a conductive metal plate material by a press or the like. As shown in FIGS. 6 to 9, the first outer conductor 51 includes a tubular portion (example of a "connecting portion") 52 for accommodating the terminal accommodating member 30 and a shield connecting portion 53 provided on the back end edge of an upper side of the tubular portion 52.

Figure 19:
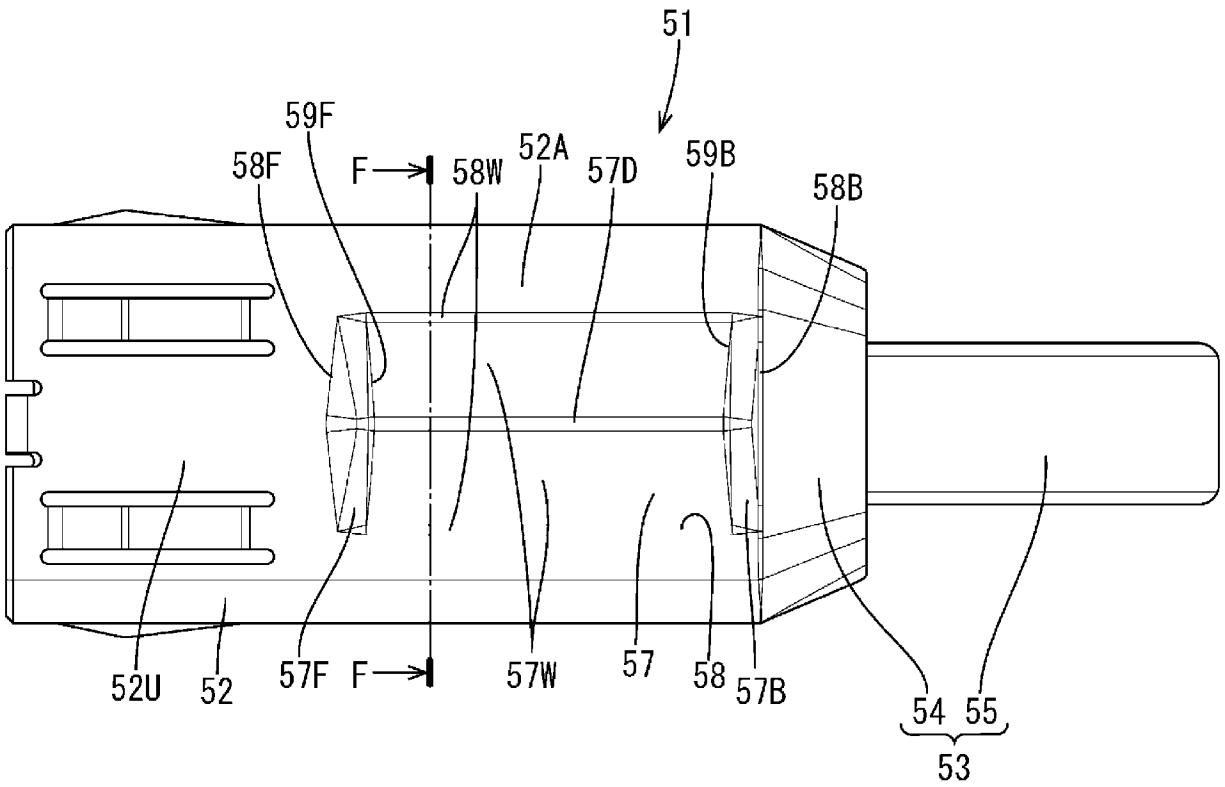
FIG. 19 is a plan view of the first outer conductor.
Figure 20:
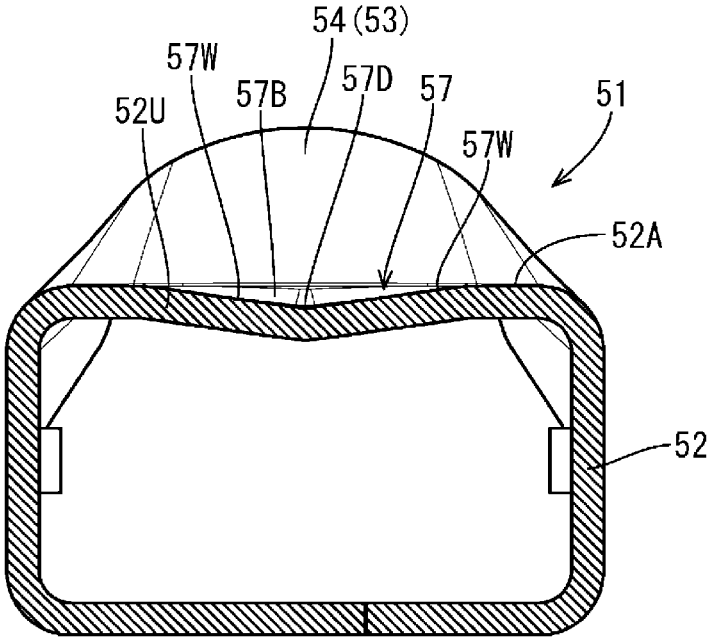
FIG. 20 is a section along F-F of FIG. 19.

As shown in FIGS. 19 and 20, the tubular portion 52 is in the form of a rectangular tube having a substantially rectangular front view shape, and the unillustrated mating outer conductor is fittable outside the tubular portion 52. An inner dimension in the lateral direction of the tubular portion 52 is slightly larger than a width in the lateral direction of the terminal accommodating member 30 and, as shown in FIG. 3, the terminal accommodating member 30 is fit and accommodated into the tubular portion 52 from behind.

Figure 7:
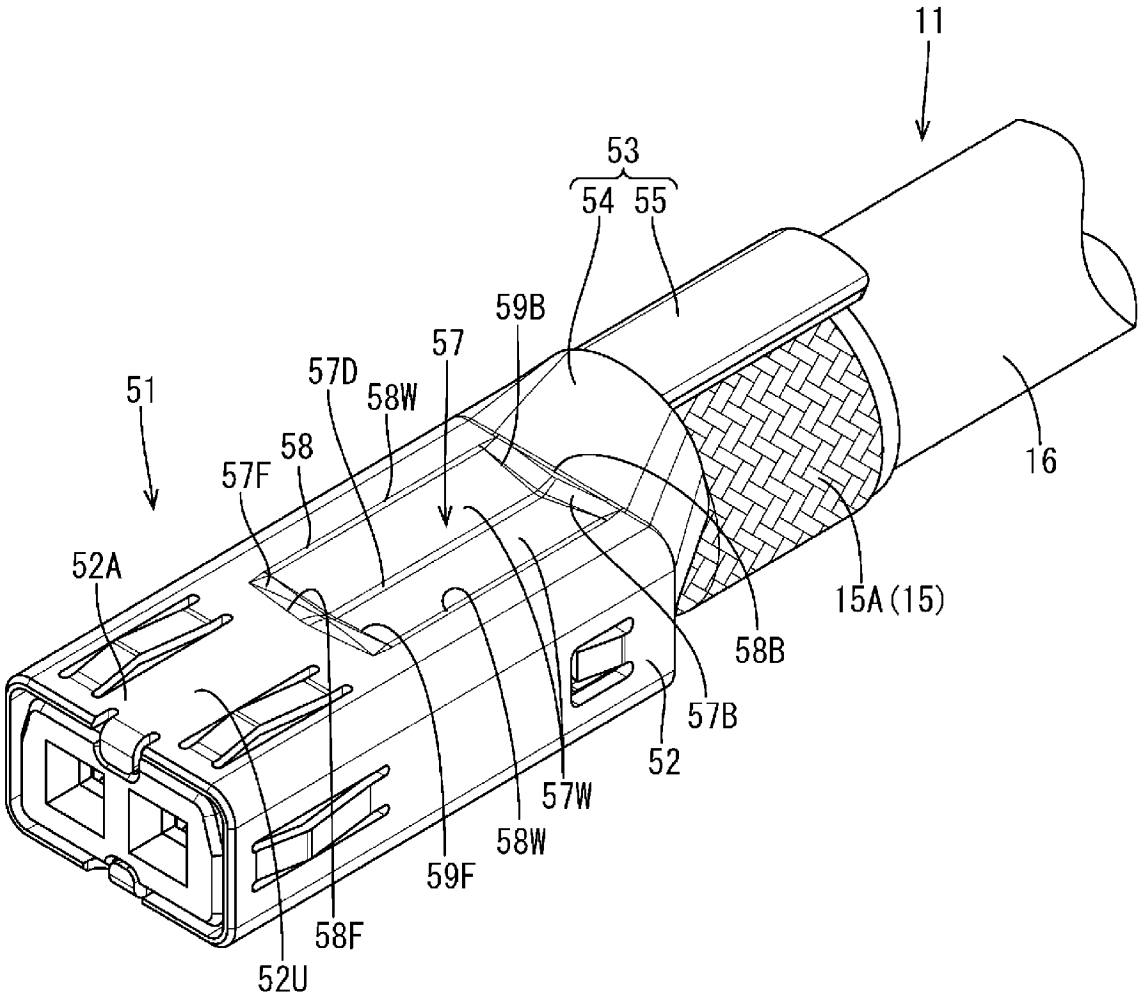
FIG. 7 is a perspective view showing a state where the terminal accommodating member is accommodated in a tubular portion.

As shown in FIGS. 6 and 7, the shield connecting portion 53 includes a linking piece 54 obliquely extending to an upper-back side from the back end edge of the upper side of the tubular portion 52 and a tongue piece 55 in the form of a substantially rectangular plate extending backward from the back end edge of the linking piece 54.

As shown in FIG. 6, the linking piece 54 is so formed that a width in the lateral direction is reduced from the back end edge of the upper side of the tubular portion 52 toward a back side.

Figure 10:
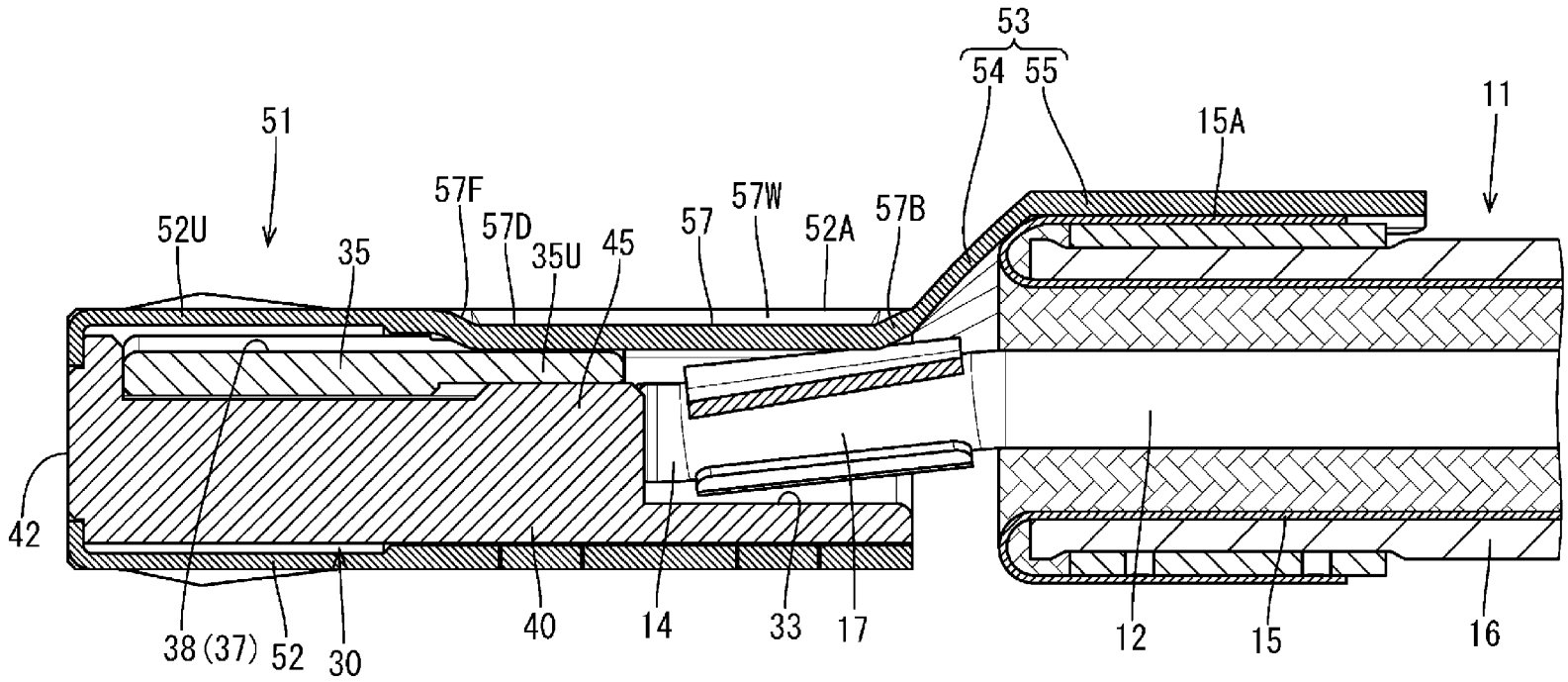
FIG. 10 is a section along C-C of FIG. 8.

The tongue piece 55 is formed to be continuous with the back end edge of the linking piece 54. When the terminal accommodating member 30 is accommodated into the tubular portion 52, the tongue piece 55 is arranged above the folded portion 15A in the shielded cable 11 as shown in FIG. 10.

Figure 11:
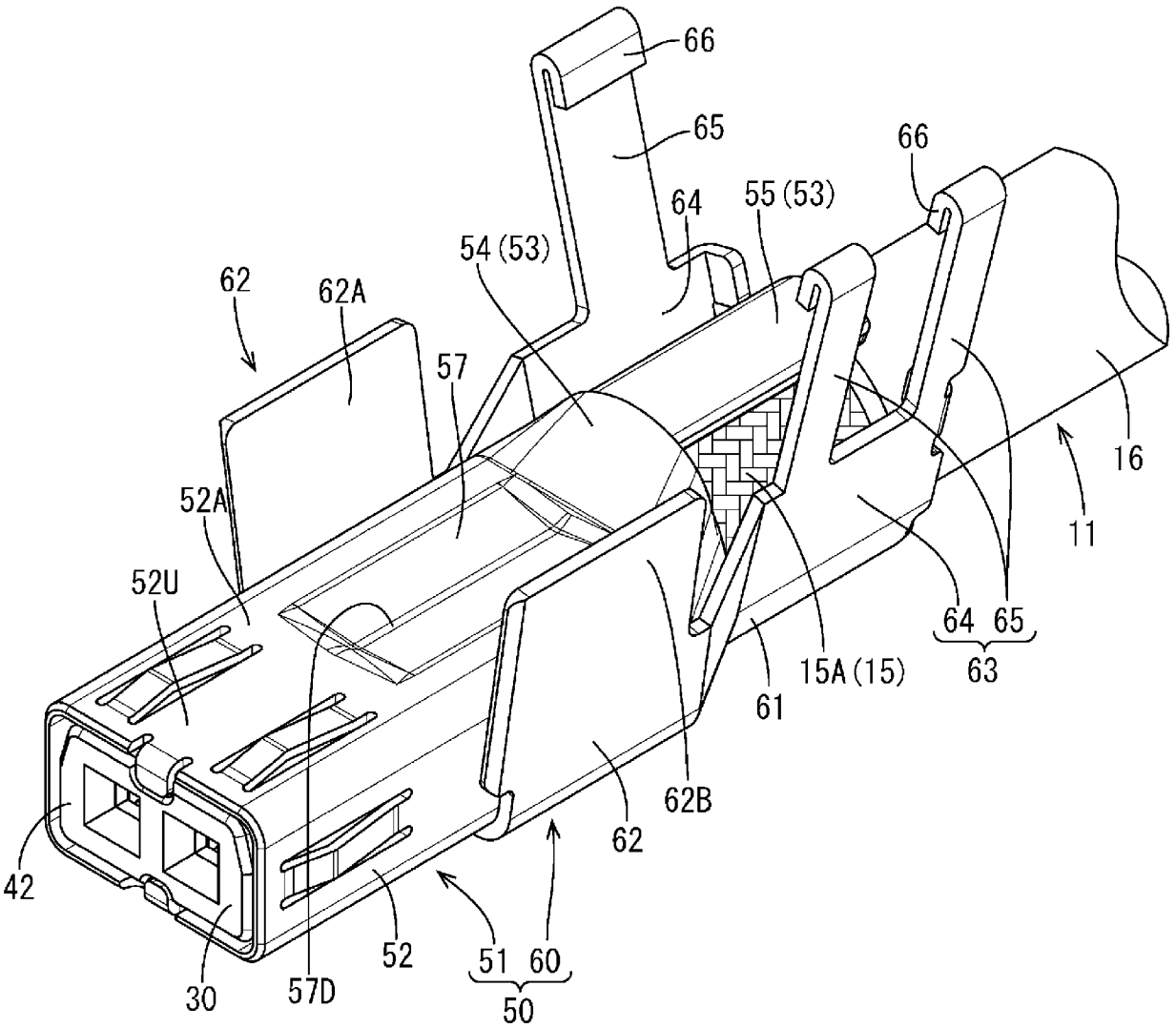
FIG. 11 is a perspective view showing a state before a second outer conductor is assembled with the first outer conductor.

The second outer conductor 60 is formed by working a conductive metal plate material by a press or the like. As shown in FIG. 11, the second outer conductor 60 includes a covering portion 61 extending from the tubular portion 52 to the position of the folded portion 15A of the shielded cable 11, a pair of fixing barrels (example of a "barrel") 62 provided on the front edge of the covering portion 61 and a pair of connection barrels 63 provided on the back edge of the covering portion 61.

Figure 21:
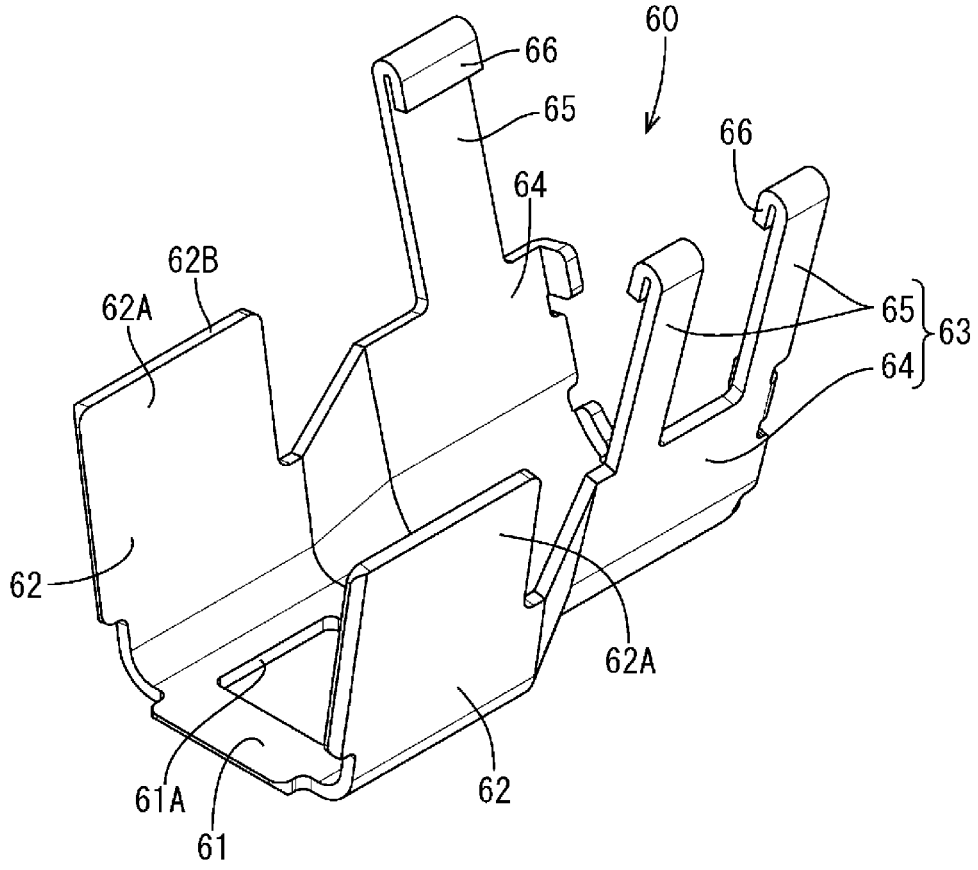
FIG. 21 is a perspective view of the second outer conductor.

The covering portion 61 is dimensioned to cover a region from a back part of the tubular portion 52 to the folded portion 15A from below, and a lance hole 61A penetrating in the vertical direction is provided in a front part of the covering portion 61 as shown in FIGS. 3 and 21.

Figure 15:
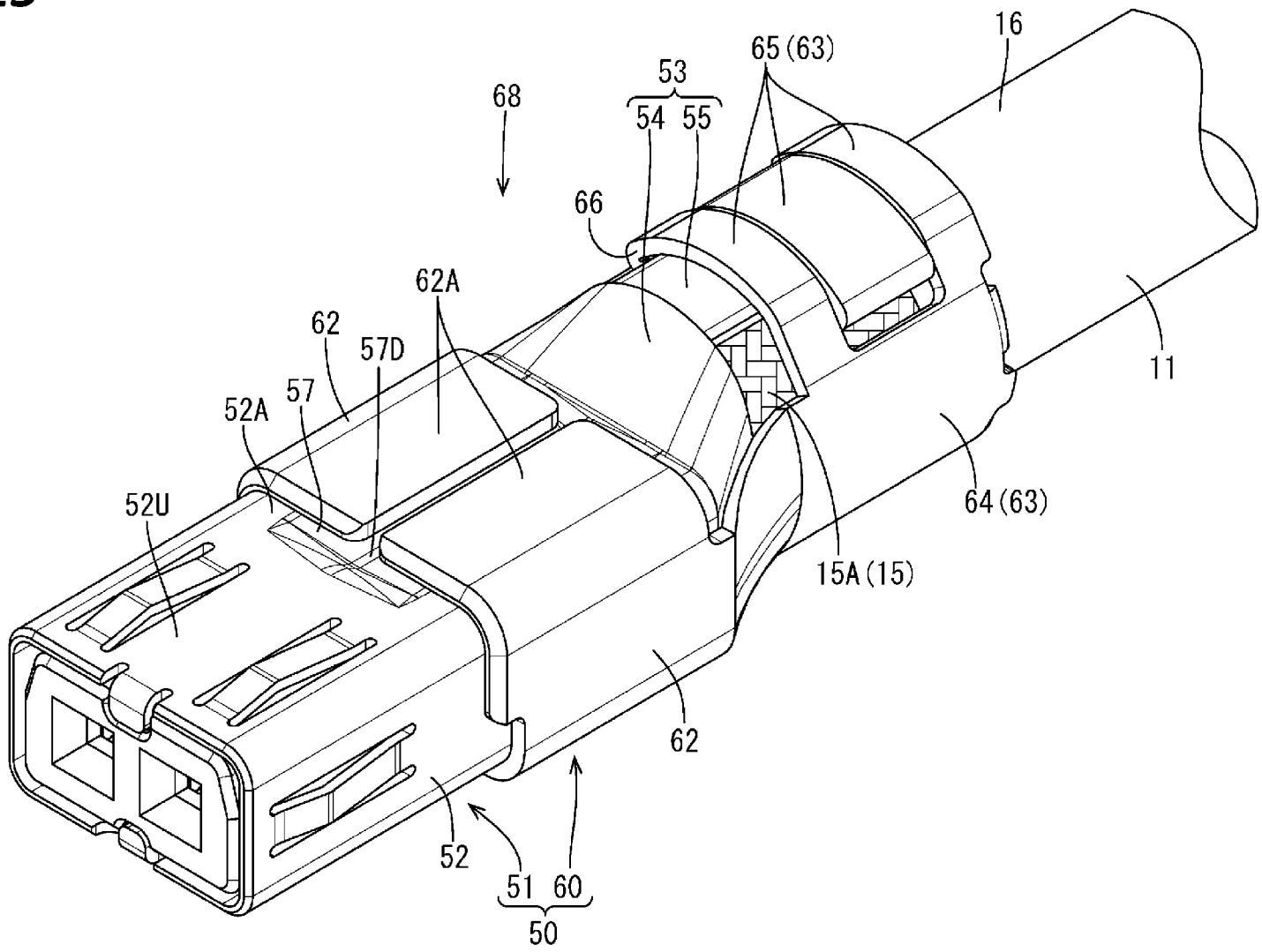
FIG. 15 is a perspective view of the terminal module in which the fixing barrels are disposed at proper crimping positions.
Figure 16:
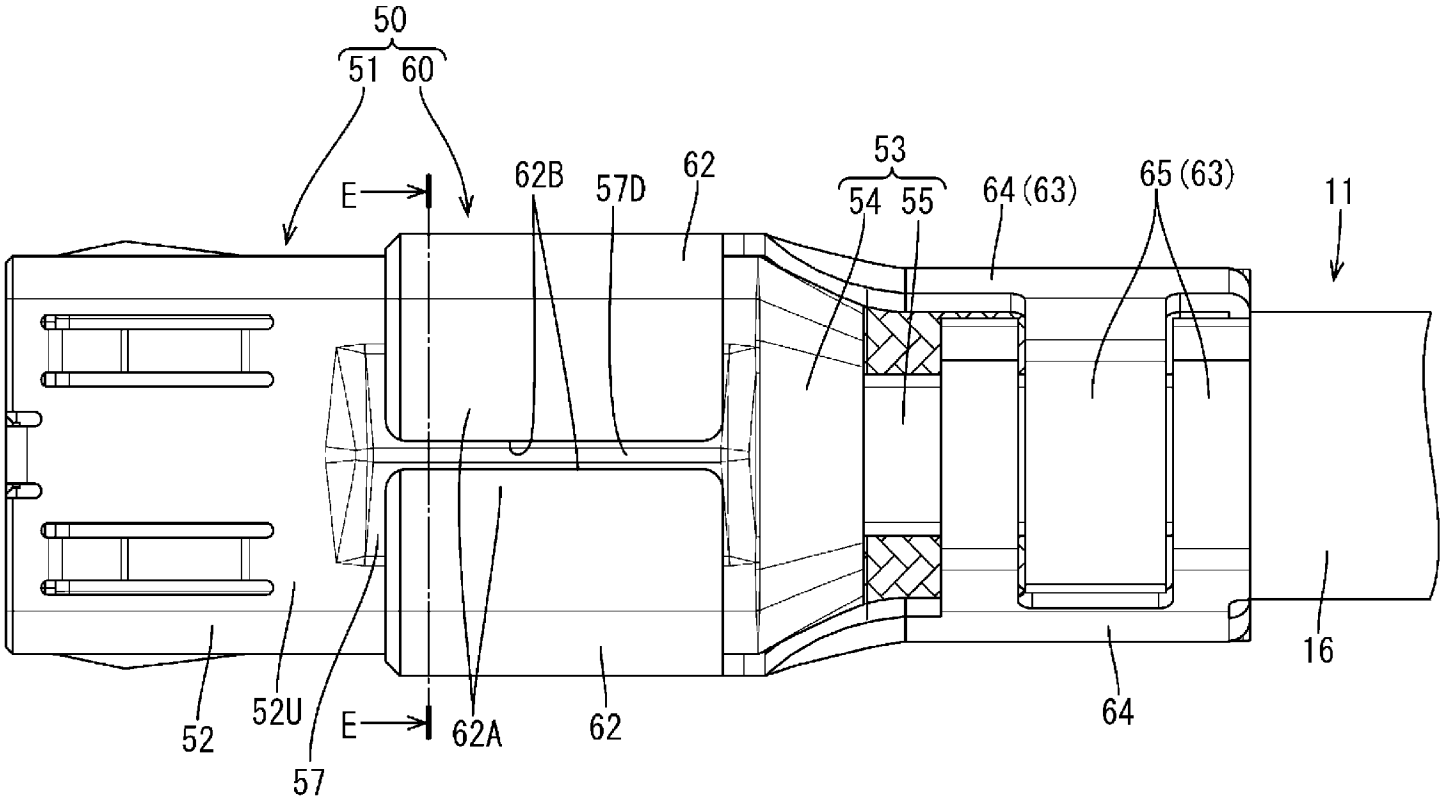
FIG. 16 is a plan view of the terminal module in which the fixing barrels are disposed at the proper crimping positions.
Figure 17:
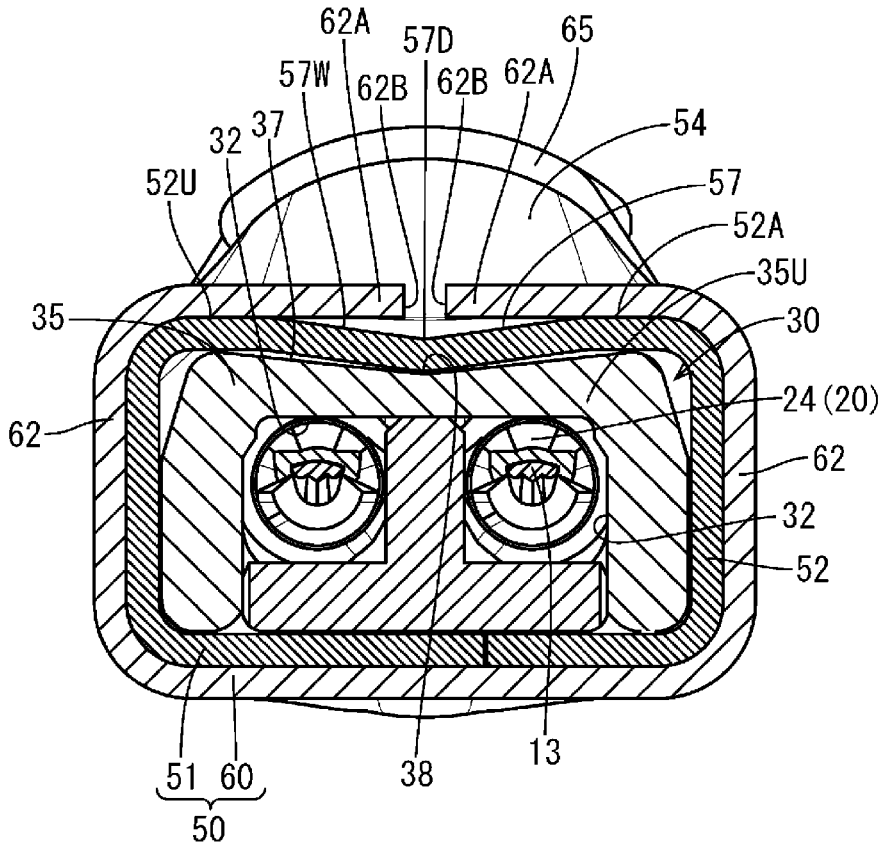
FIG. 17 is a section along E-E of FIG. 16.
Figure 22:
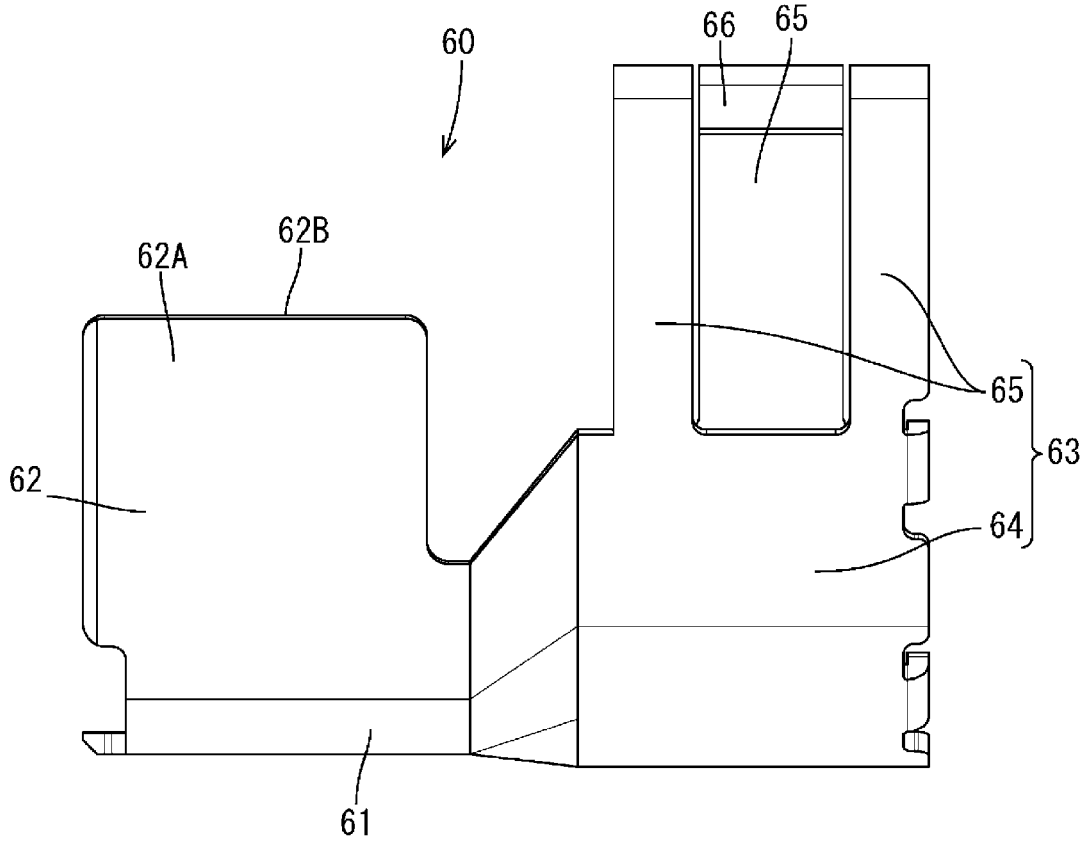
FIG. 22 is a side view of the second outer conductor.

As shown in FIGS. 21 and 22, the respective fixing barrels 62 are in the form of substantially rectangular plates and provided on side edges on both lateral sides in the front part of the covering portion 61. The pair of fixing barrels 62 extend straight from the side edges on the both lateral sides of the covering portion 61 toward oblique upper sides to be separated from each other as shown in FIG. 21 in a state before the second outer conductor 60 is assembled with the first outer conductor 51. When the second outer conductor 60 is assembled with the first outer conductor 51, the pair of fixing barrels 62 are crimped to wind around an outer surface 52A of the back part of the tubular portion 52 in a circumferential direction from both lateral sides as shown in FIGS. 15 to 17.

Further, when the pair of fixing barrels 62 are crimped to the tubular portion 52 and tip parts 62A of the pair of fixing barrels 62 are disposed at proper crimping positions to horizontally butt against each other along a ceiling plate 52U, the tip parts 62A of the pair of fixing barrels 62 are arranged to butt against each other in the lateral direction in a substantially central part in the lateral direction of the tubular portion 52.

As shown in FIGS. 21 and 22, the pair of connection barrels 63 are provided on side edges on both lateral sides in a back part of the covering portion 61 to be connected behind the pair of fixing barrels 62. One of the pair of connection barrels 63 includes a side plate 64 to be arranged along one lateral side part of the folded portion 15A and one fixing piece 65 provided on the upper end of the side plate 64, and the other connection barrel 63 includes a side plate 64 to be arranged along the other lateral side part of the folded portion 15A and two fixing pieces 65 provided on the upper end of the side plate 64.

Further, the pair of connection barrels 63 extend straight from the side edges on the both lateral sides of the covering portion 61 toward oblique upper sides to be separated from each other as shown in FIG. 21 in the state before the second outer conductor 60 is assembled with the first outer conductor 51. When the second outer conductor 60 is assembled with the first outer conductor 51, the pair of connection barrels 63 are crimped and fixed to wind around a lower part of the folded portion 15A together with the tongue piece 55 of the first outer conductor 51 arranged above the folded portion 15A as shown in FIGS. 15 to 17.

Further, a hook portion 66 folded inwardly is formed on a tip part of each fixing piece 65 as shown in FIG. 21.

As shown in FIG. 15, the hook portion 66 is hooked to either one of both lateral side edges of the tongue piece 55 when each fixing piece 65 is crimped, thereby fixing the fixing piece 65 so as not to be detached from the shield portion 15. In this way, the outer conductor 50 composed of the first and second outer conductors 51, 60 is electrically connected and fixed to the shield portion 15 of the shielded cable 11.

The ceiling plate 52U of the tubular portion 52 in the first outer conductor 51 is formed with a depressed portion 57 for allowing excessive crimping of the pair of fixing barrels 62 as shown in FIGS. 6 to 17.

Figure 8:
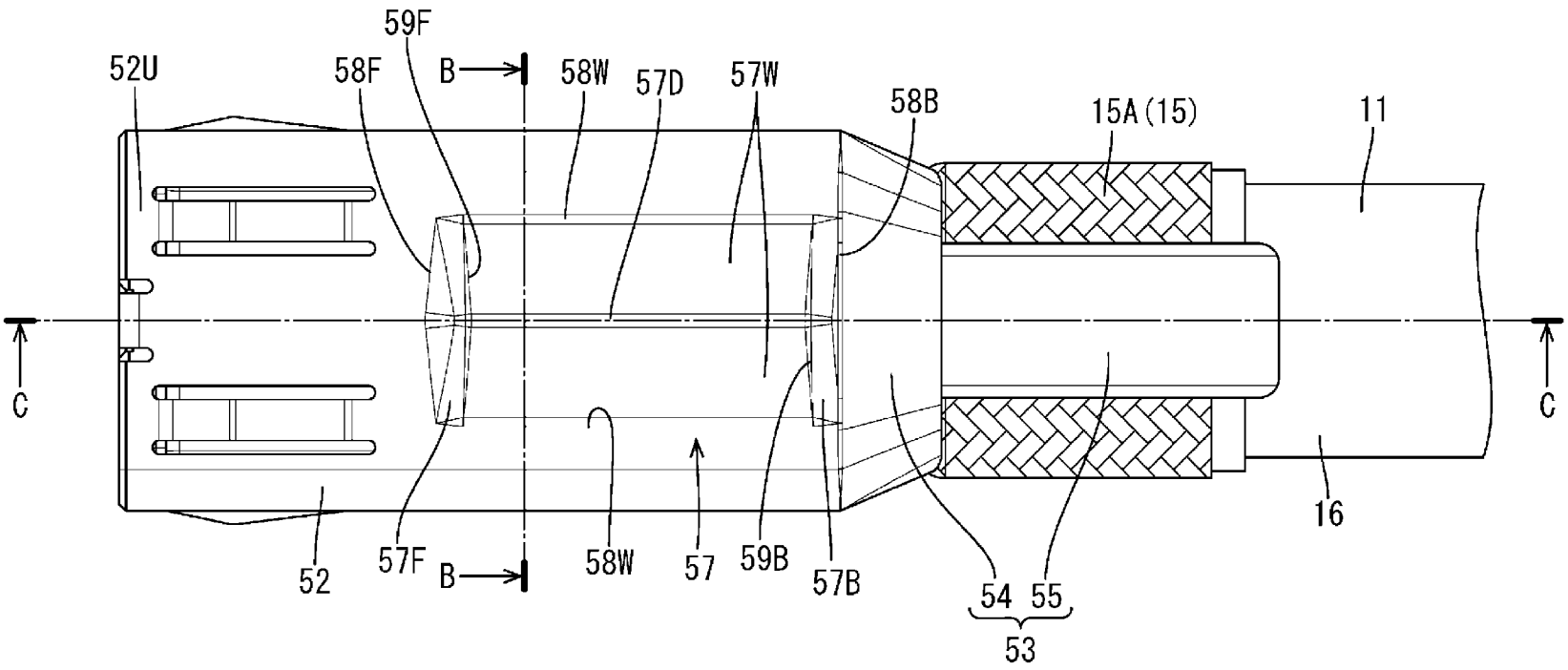
FIG. 8 is a plan view showing the state where the terminal accommodating member is accommodated in the tubular portion.

As shown in FIGS. 8 and 19, the depressed portion 57 is a bottomed recess having a substantially rectangular upper end opening 58 long in the front-back direction, and formed by a pair of inclined surfaces 57W inclined downwardly toward a substantially central part in the lateral direction from side opening edges 58W on both lateral sides of the upper end opening 58 and connected to each other in the lateral direction, a front inclined surface 57F connected to front edges 59F of the pair of inclined surfaces 57W and a front opening edge 58F of the upper end opening 58 and a back inclined surface 57B connected to back edges 59B of the pair of inclined surfaces 57W and a back opening edge 58B of the upper end opening 58. Thus, the depressed portion 57 does not penetrate through the ceiling plate 52U of the tubular portion 52 in the vertical direction as shown in FIGS. 9 and 10.

Figure 13:
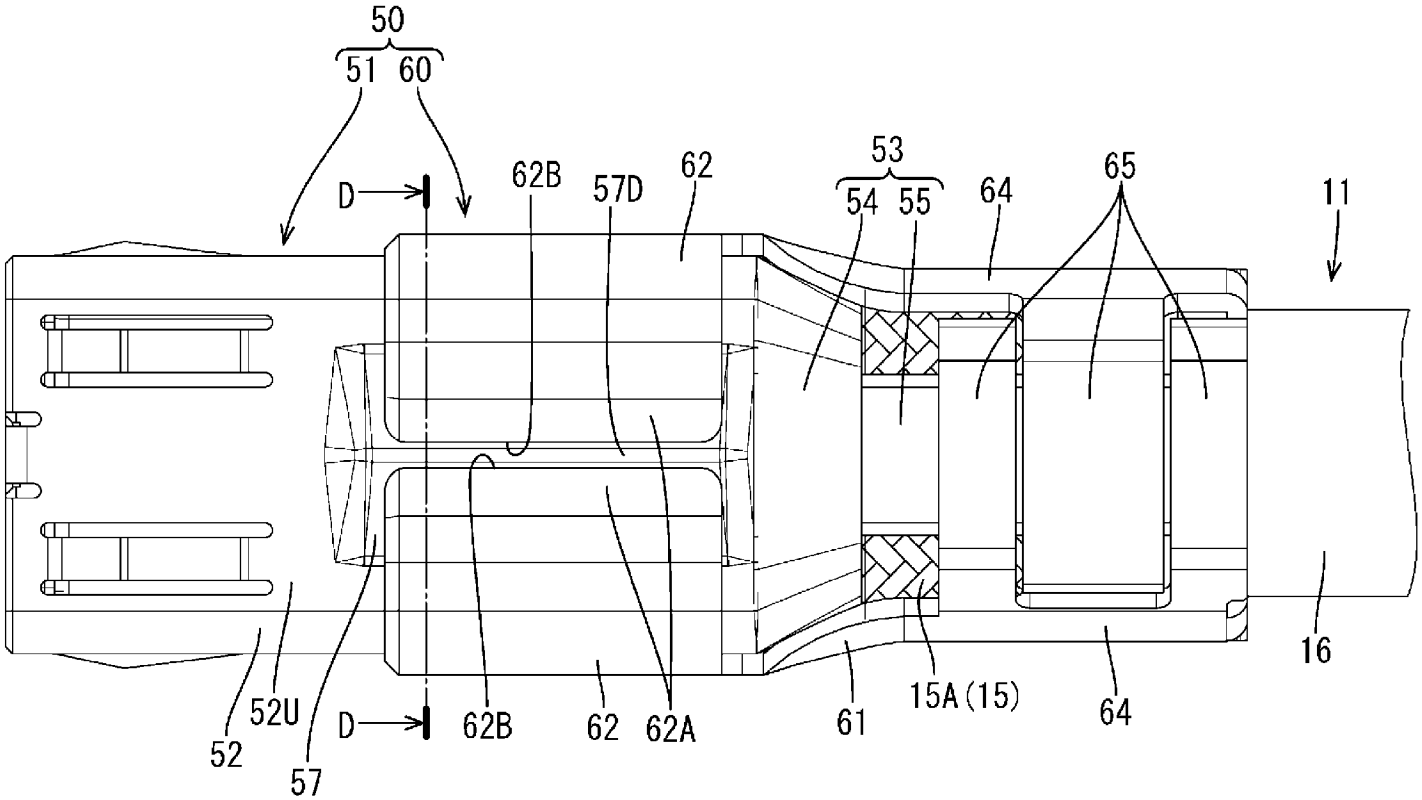
FIG. 13 is a plan view of the terminal module in which the fixing barrels are excessively deformed.

As shown in FIG. 17, the tip parts 62A of the pair of fixing barrels 62 are arranged to face the depressed portion 57 radially inward so that the tip parts 62A of the pair of fixing barrels 62 are arranged on a substantially central part in the lateral direction of the depressed portion 57. Further, the depressed portion 57 is so dimensioned that the both tip parts 62A of the pair of fixing barrels 62 can collectively enter the depressed portion 57 as shown in FIG. 13. That is, the depressed portion 57 can allow the tip parts 62A of the pair of fixing barrels 62 to be excessively crimped radially inwardly beyond proper crimping positions where the tip parts 62A are butted against each other along the ceiling plate 52U.

Figure 14:
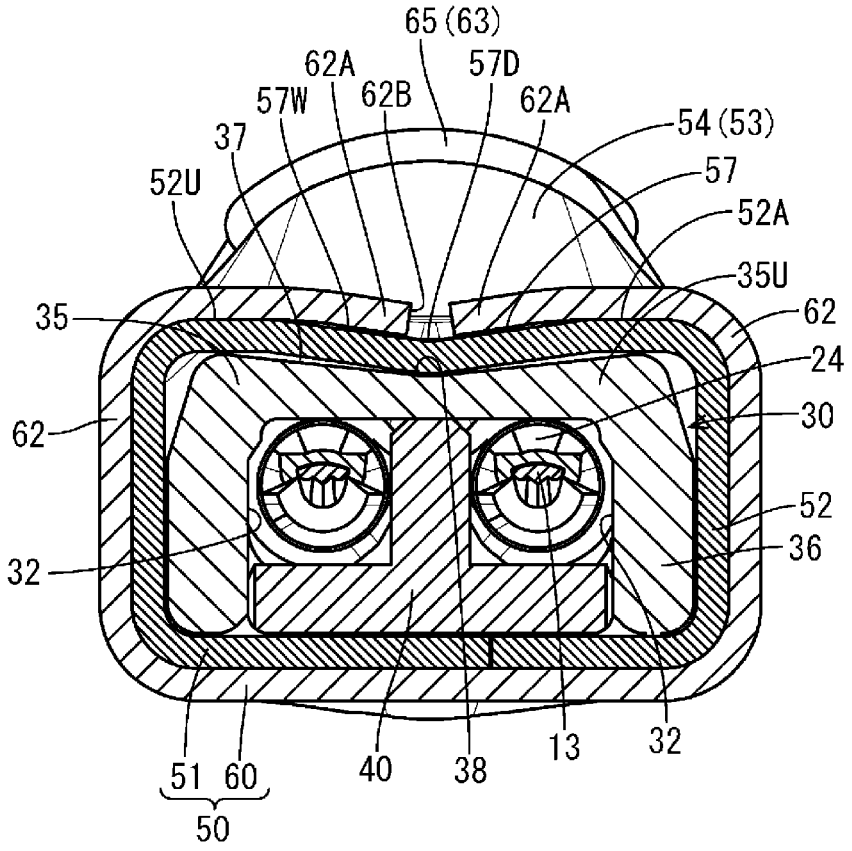
FIG. 14 is a section along D-D of FIG. 13.

Further, a part of the depressed portion 57 where the pair of inclined surfaces 57W are connected to each other serves as a conductor bottom part 57D located most downward in the depressed portion 57 as shown in FIG. 14. As the respective tip parts 62A are disposed along the respective inclined surfaces 57W when the tip parts 62A of the pair of fixing barrels 62 are crimped by being excessively bent and deformed, tips 62B of the tip parts 62A are disposed on the conductor bottom part 57D of the depressed portion 57.

On the other hand, as shown in FIGS. 9, 14 and 17, the upper wall 31U of the terminal accommodating member 30 is provided with a recessed portion 37 along which the pair of inclined surfaces 57W in the depressed portion 57 of the tubular portion 52 are disposed when the terminal accommodating member 30 is accommodated into the tubular portion 52 of the first outer conductor 51.

As shown in FIG. 6, the recessed portion 37 is recessed downwardly and formed over the entire length in the front-back direction of the upper wall 31U. Further, the recessed portion 37 includes a bottom part 38 in which a substantially central part in the lateral direction of the upper wall 31 is lowest, and is formed by inclining the upper surface of the upper wall 31U downwardly toward the bottom part 38 from both lateral side edges.

Further, as shown in FIGS. 9, 14 and 17, the bottom part 38 of the recessed portion 37 is arranged in a laterally central region different from regions, where the cavities 32 for accommodating the inner conductors 20 are arranged, in the lateral direction, which is an arrangement direction of the inner conductors 20. The thinning of a wall part constituting the cavities 32 can be suppressed by forming the recessed portion 37 in the upper wall 31U of the terminal accommodating member 30.

This embodiment is configured as described above. Next, an example of an assembling procedure of the connector 10 for communication is briefly described and, then, functions and effects of the connector 10 are described.

First, the sheath portion 16 of the shielded cable 11 is stripped to expose the ends of the two coated wires 12 and the shield portion 15, and the shield portion 15 is folded on the outer surface of the sheath portion 16 to form the folded portion 15A. Further, the insulation coatings 14 of the front end parts of the two coated wires 12 are stripped to expose the cores 13 and the inner conductors 20 are connected by crimping the wire connecting portions 24 to the exposed cores 13.

Subsequently, the adjusting member 80 is mounted on the exposed portions 17 of the two coated wires 12 of the shielded cable 11. Here, in a developed state before being mounted on the exposed portions 17, the adjusting member 80 is in such a state that an upper part constituting the adjusting bodies 82 is open upward as shown in FIG. 4. The exposed portions 17 of the coated wires 12 are arranged on the adjusting member 80 with the open adjusting bodies 82, and the adjusting bodies 82 are crimped to wind around the exposed portions 17, whereby the adjusting member 80 is fixed to the exposed portions 17.

Subsequently, as shown in FIG. 5, the two inner conductors 20 are mounted on the bottom wall 40D of the vertically inverted lower member 40 and the upper member 35 is assembled with the lower member 40 from above. In this way, the inner conductors 20 are accommodated into the terminal accommodating member 30 as shown in FIG. 6.

Subsequently, as shown in FIGS. 7 to 10, the terminal accommodating member 30 is inserted into the tubular portion 52 in the first outer conductor 51 of the outer conductor 50 from behind. Then, the pair of inclined surfaces 57W in the depressed portion 57 of the tubular portion 52 are disposed on and along the recessed portion 37 of the terminal accommodating member 30.

Subsequently, as shown in FIG. 11, the second outer conductor 60 is assembled with the first outer conductor 51. The second outer conductor 60 is assembled by placing the first outer conductor 51 and the folded portion 15A of the shielded cable 11 on the covering portion 61 of the second outer conductor 60 and, as shown in FIGS. 12 to 17, crimping the fixing barrels 62 to wind around the tubular portion 52 and crimping the respective fixing pieces 65 of the connection barrels 63 to wind around the tongue piece 55 and the shield portion 15.

Here, if the respective fixing pieces 65 are crimped to the tongue piece 55 and the shield portion 15, the hook portions 66 of the fixing pieces 65 are hooked to the side edges of the tongue piece 55 as shown in FIG. 12, whereby the fixing pieces 65 are fixed so as not to be detached from the tongue piece 55 and the shield portion 15.

However, the pair of fixing barrels 62 are not configured to be hooked to the tubular portion 52. Further, if the fixing barrels 62 are crimped to wind around the outer peripheral surface of the tubular portion 52, the fixing barrels 62 are deformed by being crimped, but there is a concern that the fixing barrels 62 are lifted from the outer surface 52A of the tubular portion 52 due to so-called springback to slightly return to an initial state.

Accordingly, in crimping the pair of fixing barrels 62 to the tubular portion 52, the tip parts 62A of the pair of fixing barrels 62 are caused to enter the depressed portion 57 as shown in FIGS. 12 to 14, whereby the tip parts 62A of the pair of fixing barrels 62 are allowed to be excessively crimped radially inwardly beyond the proper crimping positions and the pair of fixing barrels 62 are crimped to the tubular portion 52. Further, if the tip parts 62A of the pair of fixing barrels 62 are crimped to the tubular portion 52 by being excessively bent and deformed, the respective tip parts 62A are disposed on and along the respective inclined surfaces 57W and the tips 62B of the tip parts 62A are disposed on the conductor bottom part 57D of the depressed portion 57 as shown in FIG. 14.

If the crimping operation of the fixing barrels 62 is finished, the tip parts 62A of the fixing barrels 62 are lifted up from the inclined surfaces 57W of the depressed portion 57 due to springback and, as shown in FIGS. 15 and 17, arranged at the proper crimping positions. In this way, the terminal module 68 shown in FIGS. 15 to 17 is completed.

Finally, the terminal module 68 is inserted into the mold accommodating portion 72 of the housing 70 from behind. If the terminal module 68 reaches a proper accommodation position, the locking lance 73 is fit into the lance hole 61A of the outer conductor 50 and the terminal module 68 is retained and held in the housing 70 as shown in FIG. 3. In this way, the connector 10 for communication is completed.

As described above, the terminal module 68 in the connector 10 of this embodiment is provided with the shielded cable 11 including the conductive shield portion 15 for covering the outer periphery of at least one coated wire 12 and the sheath portion 16 for covering the outer periphery of the shield portion 15, the first outer conductor 51 made of metal, including the tubular portion (connecting portion) 52 in the form of a rectangular tube and to be connected to the shield portion 15, and the second outer conductor 60 including at least one plate-like fixing barrel (barrel) 62 to be crimped to wind around the outer surface 52A of the tubular portion 52 in the circumferential direction, and the tubular portion 52 includes the depressed portion 57 arranged inside to radially face the fixing barrels 62 and allowing the fixing barrels 62 to be crimped by causing the fixing barrels 62 to be excessively deformed beyond the proper crimping positions as shown in FIGS. 15 and 17.

Specifically, according to this embodiment, when the fixing barrels 62 of the second outer conductor 60 are crimped to wind around the tubular portion 52 of the first outer conductor 51 in the circumferential direction, the fixing barrels 62 can be excessively deformed and crimped to the tubular portion 52 by being caused to enter the depressed portion 57.

That is, the fixing barrels 62 excessively deformed to enter the depressed portion 57 slightly return to the initial state due to springback, and are arranged at the proper crimping positions. In this way, it can be suppressed that the fixing barrels 62 are arranged at improper crimping positions lifted from the outer surface 52A of the tubular portion 52.

Further, as shown in FIGS. 9 and 10, the depressed portion 57 is a bottomed recess recessed from the outer surface 52A of the tubular portion 52, and does not penetrate through the tubular portion 52. According to this configuration, by excessively deforming the fixing barrels 62 in the depressed portion 57 of the tubular portion 52, the arrangement of the fixing barrels 62 at improper crimping positions can be suppressed and the formation of a through hole in the tubular portion 52 can be prevented, whereby a reduction in the shielding performance of the tubular portion 52 can be suppressed.

Generally, if a plate-like metal piece is crimped to wind around something, a tip part of the metal piece tends to be largely lifted due to springback. However, according to this embodiment, since the depressed portion 57 is formed at a position radially facing the tip parts 62A of the fixing barrels 62, it can be suppressed that the tip parts 62A of the fixing barrels 62 largely affected by lifting due to springback are arranged at improper crimping positions.

Further, the second outer conductor 60 of this embodiment includes the pair (a plurality of) fixing barrels 62, and the depressed portion 57 is formed in such a size that the tip parts 62A of the pair of fixing barrels 62 can collectively enter the depressed portion 57. According to this configuration, as shown in FIGS. 12 to 14, the tip parts 62A of the pair of fixing barrels 62 can collectively enter one depressed portion 57 in crimping the pair of fixing barrels 62. Thus, it can be suppressed that the shape of the tubular portion 52, eventually of the first outer conductor 51, becomes complicated, for example, as compared to the case where the tubular portion 52 is formed with a plurality of depressed portions 57.

Furthermore, in this embodiment, the shielded cable 11 includes two (a plurality of) coated wires 12, the terminal accommodating member 30 is further provided which is accommodated into the tubular portion 52 with the inner conductors 20 connected to the coated wires 12 accommodated side by side in the terminal accommodating member 30 and, as shown in FIGS. 9, 14 and 17, the terminal accommodating member 30 is provided with the recessed portion 37 recessed along the depressed portion 57 and having the bottom part 37 in the laterally central region different from the regions, where the inner conductors 20 are arranged, in the arrangement direction of the inner conductors (terminals) 20. That is, by forming the terminal accommodating member 30 with the recessed portion 37, the thinning of the wall part in a part for accommodating the inner conductors 20 can be suppressed.

Second Embodiment

Figure 23:
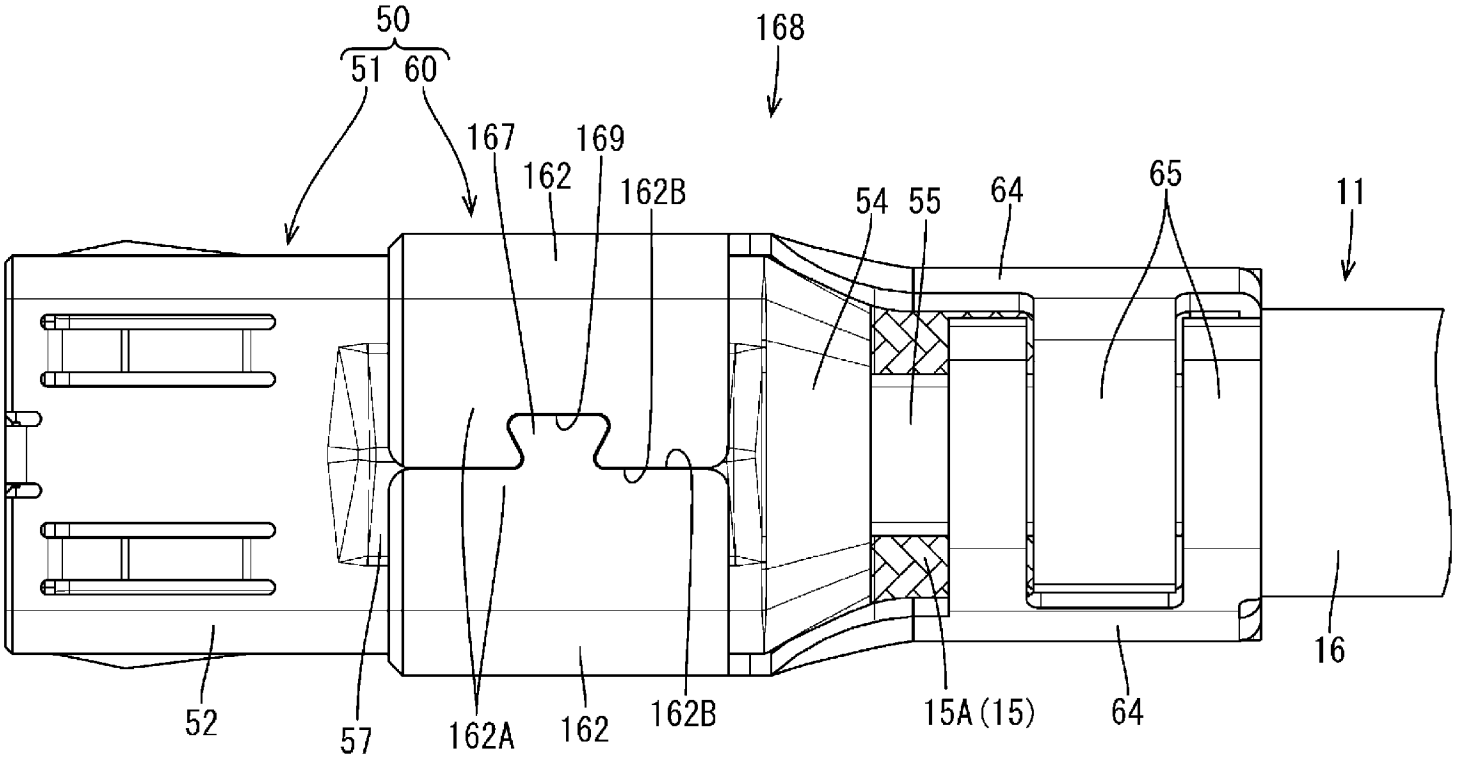
FIG. 23 is a plan view showing a state before a terminal accommodating member is mounted into a first outer conductor according to a second embodiment.

Next, a second embodiment is described with reference to FIG. 23.

A terminal module 168 of the second embodiment is obtained by changing the shapes of the pair of fixing barrels 62 in the first embodiment, and components, functions and effects common to the first embodiment are not described to avoid repetition. Further, the same components as those of the first embodiment are denoted by the same reference signs.

A tip part 162A of one of a pair of fixing barrels 162 of the second embodiment is formed with a fitting protrusion 167 projecting from a tip edge 162B, and a tip part 162A of the other fixing barrel 162 is formed with a fitting groove 169 fittable to the fitting protrusion 167.

The fitting groove 169 is in the form of a dovetail groove whose length in the front-back direction increases from the tip edge 162B toward a back part.

The fitting protrusion 167 is formed into a dovetail shape whose length in the front-back direction increases with distance from the tip edge 162B.

The fitting protrusion 167 and the fitting groove 169 are fit when the tip parts 162A of the pair of fixing barrels 162 are excessively bent and deformed with respect to a tubular portion 52 and the tip parts 162A are lifted from inclined surfaces 57W of a depressed portion 57 due to springback to be arranged at proper crimping positions.

That is, since the fitting protrusion 167 and the fitting groove 169 of the pair of fixing barrels 162 are fit when the respective tip parts 162A are at the proper crimping positions, the lifting of the pair of fixing barrels 62 from an outer surface 52A of the tubular portion 52 can be further suppressed.

Other Embodiments

The technique disclosed in this specification is not limited to the above described and illustrated embodiments and includes, for example, the following various modes.

(1) In the above embodiments, the first outer conductor 51 including the tubular portion 52 for accommodating the terminal accommodating member 30 is configured as a first conductor. However, without limitation to this, the first conductor may be configured as a female terminal including a tubular portion into which a male terminal is to be inserted.

(2) In the above embodiments, the shielded cable 11 includes two coated wires 12 and the terminal accommodating member 30 accommodates two inner conductors 20. However, without limitation to this, a shielded cable may include three or more coated wires and a terminal accommodating member may accommodate three or more inner conductors.

(3) In the above embodiments, the inner conductor 20 is configured as a male terminal. However, without limitation to this, an inner conductor may be configured as a female terminal.

LIST OF REFERENCE NUMERALS

10: connector
11: shielded cable
12: coated wire
15: shield portion
16: sheath portion
30: terminal accommodating member
37: recessed portion
38: bottom part
51: first outer conductor (example of "first conductor")
52: tubular portion (example of "connecting portion")
57: depressed portion
60: second outer conductor (example of "second conductor")
62: fixing barrel (example of "barrel")
62A: tip part of fixing barrel
68: terminal module (example of "cable with terminal")
70: housing

What is claimed is:

1. A cable with terminal, comprising:

a shielded cable including a conductive shield portion for covering an outer periphery of at least one coated wire and a sheath portion for covering an outer periphery of the shield portion;

a first conductor made of metal, including a tubular connecting portion and to be connected to the shield portion; and a second conductor including at least one plate-like barrel to be crimped to wind around an outer surface of the connecting portion in a circumferential direction, wherein the connecting portion includes a depressed portion arranged inside to radially face the barrel and allowing the barrel to be crimped by causing the barrel to be excessively deformed beyond a proper crimping position, and wherein the depressed portion is a bottomed recess recessed from the outer surface of the connecting portion, and does not penetrate through the connecting portion.

2. The cable with terminal of claim 1, wherein the depressed portion is formed at a position radially facing a tip part of the barrel.

3. The cable with terminal of claim 2, wherein:

the second conductor includes a plurality of the barrels, and the depressed portion is formed in such a size that tip parts of the plurality of barrels collectively enter the depressed portion.

4. The cable with terminal of claim 1, wherein:

the shielded cable includes a plurality of the coated wires, the cable with terminal further comprises a terminal accommodating member to be accommodated into the connecting portion with terminals connected to the coated wires accommodated side by side in the terminal accommodating member, and the terminal accommodating member is provided with a recessed portion formed by being recessed along the depressed portion and having a bottom part in a region different from regions, where the terminals are arranged, in an arrangement direction of the terminals.

5. A connector, comprising:

the cable with terminal of claim 1; and a housing for accommodating the cable with terminal.

* * * * *